US009970291B2

(12) United States Patent
Lamond

(10) Patent No.: US 9,970,291 B2
(45) Date of Patent: May 15, 2018

(54) FILL FENCE SYSTEM AND METHOD FOR INSTALLING SAME

(71) Applicant: Sturda Inc., Val Caron (CA)

(72) Inventor: Robert Lamond, Azilda (CA)

(73) Assignee: Sturda Inc., Val Caron, Ontario (CA)

( * ) Notice: Subject to any disclaimer, the term of this patent is extended or adjusted under 35 U.S.C. 154(b) by 0 days. days.

(21) Appl. No.: 15/724,504

(22) Filed: Oct. 4, 2017

(65) Prior Publication Data

US 2018/0094524 A1 Apr. 5, 2018

(30) Foreign Application Priority Data

Oct. 4, 2016 (CA) ..... 2944212

(51) Int. Cl.

| | |
|---|---|
| ***E21D 11/10*** | (2006.01) |
| ***E21D 11/15*** | (2006.01) |
| ***E21F 15/02*** | (2006.01) |
| ***E21D 11/40*** | (2006.01) |
| ***E02D 29/02*** | (2006.01) |

(52) U.S. Cl.

CPC ..... *E21D 11/102* (2013.01); *E02D 29/0266* (2013.01); *E21D 11/107* (2013.01); *E21D 11/40* (2013.01); *E21F 15/02* (2013.01); *E21D 11/152* (2013.01); *E21D 11/155* (2013.01)

(58) Field of Classification Search

CPC ... E21D 11/102; E21D 11/152; E21D 11/155; E21D 19/02; E21D 19/04; E21F 15/02; E21F 17/103; E21F 17/12; E21F 17/16

USPC ..... 299/11, 12; 454/168, 169, 170

See application file for complete search history.

(56) References Cited

U.S. PATENT DOCUMENTS

| | | | | |
|---|---|---|---|---|
| 4,096,702 | A | 6/1978 | Burton | |
| 6,379,084 | B1 * | 4/2002 | Kennedy | E21F 1/145 248/354.4 |
| 6,846,132 | B2 * | 1/2005 | Kennedy | E21F 1/10 299/12 |
| 6,857,706 | B2 | 2/2005 | Hames et al. | |
| 7,438,506 | B2 * | 10/2008 | Kennedy | E21F 17/103 299/11 |
| 8,424,973 | B2 | 4/2013 | Bodley et al. | |
| 2003/0143942 | A1 * | 7/2003 | Kennedy | E21F 1/145 454/169 |
| 2011/0272402 | A1 | 11/2011 | Lamond | |

(Continued)

FOREIGN PATENT DOCUMENTS

CA 2892348 A1 11/2015

*Primary Examiner* — Frederick L Lagman

(57) ABSTRACT

A method of installing a fill fence system at a predetermined location to at least partially cover an opening defined by a back, a floor, and side walls. The method includes providing a carrier system including a carrier assembly, locating the carrier assembly in a safe zone adjacent to the unsafe zone, and positioning an assembled fill fence assembly on the carrier assembly. The carrier assembly and the full fence assembly are moved to a preselected location. With the carrier assembly at the preselected location, the fill fence assembly is positioned at the predetermined location, and installed at least partially to cover the opening. The carrier assembly is disengaged from the fill fence assembly and removed from the preselected location. The fill fence system includes a securing element is applied to help secure the fill fence assembly in the opening.

3 Claims, 35 Drawing Sheets

(56) References Cited

U.S. PATENT DOCUMENTS

2011/0297057 A1* 12/2011 Kennedy ..... E21D 21/00
109/79

* cited by examiner

FILL FENCE SYSTEM AND METHOD FOR INSTALLING SAME

FIELD OF THE INVENTION

The present invention is a fill fence system and a method for installing same.

BACKGROUND OF THE INVENTION

As is well known in the art, fill fences are used in underground mining to hold backfill in a mined-out stope, or other open region. Construction of the fill fence, previously a labour-intensive task, is now less so due to recently-developed fill fences, for example, as described in Canadian patent application no. 2,892,348.

However, there are a number of unresolved problems in the prior art. First, installing the fill fence typically requires workers to be present at the locations at the side walls and the back where the fill fence is to be installed, to secure the fill fence to the side walls and the back. Because these locations are immediately adjacent to a relatively large mined-out region, they are usually considered unsafe, and the workers are at risk when they are working in these locations. Second, the problem of securing the fill fence to the back and the side walls has typically been addressed using labour-intensive methods.

SUMMARY OF THE INVENTION

For the foregoing reasons, there is a need for a fill fence and a method and system for installing same that overcome or mitigate one or more of the disadvantages or defects of the prior art. Such disadvantages or defects are not necessarily included in those described above.

In its broad aspect, the invention provides a carrier assembly for installing a fill fence assembly in a predetermined location to at least partially cover an opening. The carrier assembly includes a chassis subassembly comprising a chassis and a mast subassembly to which the fill fence assembly is securable. The mast subassembly includes a mast frame pivotably mounted to the chassis and fastening elements mounted on the mast frame. The fastening elements are configured for releasably securing one or more preselected portions of the fill fence assembly to the mast frame. The carrier assembly also includes a lifting subassembly for raising the mast frame, when the fill fence assembly is secured to the mast frame, from a lowered position, in which the mast frame is non-vertical, to a raised position in which the mast frame is non-horizontal, to position the fill fence assembly in the predetermined location.

In another of its aspects, the invention provides a carrier system for installing a fill fence assembly in a predetermined location to at least partially cover an opening. The carrier system includes a carrier assembly including a chassis subassembly having a chassis 52, and a mast subassembly to which the fill fence assembly is securable, the mast subassembly comprising a mast frame pivotably mounted to the chassis and fastening elements mounted on the mast frame. The fastening elements are configured for releasably securing one or more preselected portions of the fill fence assembly to the mast frame. The carrier assembly also provides a lifting subassembly for raising the mast frame, when the fill fence assembly is secured to the mast frame, from a lowered position, in which the mast frame is non-vertical, to a raised position in which the mast frame is non-horizontal, to position the fill fence assembly in the predetermined location. The carrier system also includes a control unit for remote control of the carrier assembly. The control unit is operably connected with one or more securing means for securing the fill fence assembly to a number of walls at a preselected location, to control the securing means.

In another of its aspects, the invention provides a method of installing the fill fence system in the predetermined location to at least partially cover the opening defined by a back, an opposed floor, and left and right walls, the fill fence system including a fill fence assembly. The method includes providing the carrier system having the carrier assembly. The carrier assembly is located in a safe zone that is spaced apart from the predetermined location. With the mast frame in the lowered position, one or more preselected portions of a body subassembly of the fill fence assembly is positioned on the mast frame, and the one or more preselected portions of the fill fence assembly are securable to the mast frame by the fastening elements. With the fastening elements, the preselected portions of the fill fence assembly are secured to the mast frame. With the fill fence assembly secured to the mast frame, moving the carrier assembly from the safe zone to a preselected location in an unsafe zone proximal to the predetermined location, from which the fill fence assembly may be positioned in the predetermined location by the carrier system. With the carrier assembly at the preselected location, the mast frame is raised to its raised position, to position the fill fence assembly in the predetermined location therefor. Via the control unit, the securing means are activated, to secure the body subassembly in a non-horizontal position to the back, the floor, and the left and right walls in the predetermined location. Gaps are defined between the body subassembly and the back, the floor, and the left and right walls respectively. The preselected portions of the fill fence assembly are released from the mast frame, by releasing the fastening elements therefrom. The mast frame is moved to the lowered position. The carrier assembly is moved to the safe zone.

In yet another of its aspects, the invention provides a fill fence system for substantially covering an opening that is in communication with an open region when the fill fence system is located in a predetermined location. The opening is defined by a back, an opposed floor and opposing left and right walls. The fill fence system includes a fill fence assembly including a body subassembly having an inner side formed to be facing toward the open region and an outer side formed to be facing away from the open region when the fill fence assembly is installed in the predetermined location. The body subassembly includes a central post and a number of cross-members mounted to the central post. Each cross-member extends between left and right ends thereof. The cross-members include an uppermost cross-member positioned to be located uppermost when the fill fence assembly is installed in the predetermined location, and a lowermost cross-member positioned to be located lowermost when the fill fence assembly is installed in the predetermined location. The body subassembly also includes a left side plate and a right side plate, mounted to the left and right ends of the cross-members respectively. The fill fence assembly also includes one or more screens positioned on the inner side of the body subassembly, the screen having an exterior side at least partially engaged with the inner side of the body subassembly, and an interior side facing toward the open region when the fill fence system is installed in the predetermined location. In addition, the fill fence assembly includes one or more membranes positioned on the interior side of the screen, and a number of air cylinder subassemblies mounted to the left and right side plates respectively, each air cylinder subassembly including an air cylinder and a rebar element, the air cylinder being activatable to extend the rebar element away from the central post to an extended position thereof. The fill fence assembly also includes left and right expandable mesh elements. The left expandable mesh element extends between an inner side thereof secured to the left side plate and an outer side thereof secured to respective outer ends of the rebar elements positioned proximal to the left side plate. The right expandable mesh element extends between an inner side thereof secured to the right side plate and an outer side thereof secured to respective outer ends of the rebar elements positioned proximal to the right side plate. When the fill fence assembly is in the predetermined location, the central post is positioned in a non-horizontal position between the back and the floor, to locate the cross-members in non-vertical positions respectively, and to locate the left and right ends of the cross-members proximal to the left and right walls respectively. When the fill fence assembly is in the predetermined location, the left and right side plates define respective left side and right side gaps between the left side plate and the left wall, and the right side plate and the right wall. Upon activation of the air cylinders, the outer ends of the rebar elements are extended to engage the left and right walls respectively, to expand the left and right expandable mesh elements at least partially over the left side gap and the right side gap respectively.

In addition, when the fill fence assembly is in the predetermined location, the uppermost cross-member defines an upper gap between the uppermost cross-member and the back, and the lowermost cross-member defines a lower gap between the lowermost cross-member and the floor. The fill fence system additionally includes a securing element at least partially covering the upper gap, the lower gap, and the left and right side gaps.

BRIEF DESCRIPTION OF THE DRAWINGS

The invention will be better understood with reference to the attached drawings, in which.

DETAILED DESCRIPTION

Figure 17:
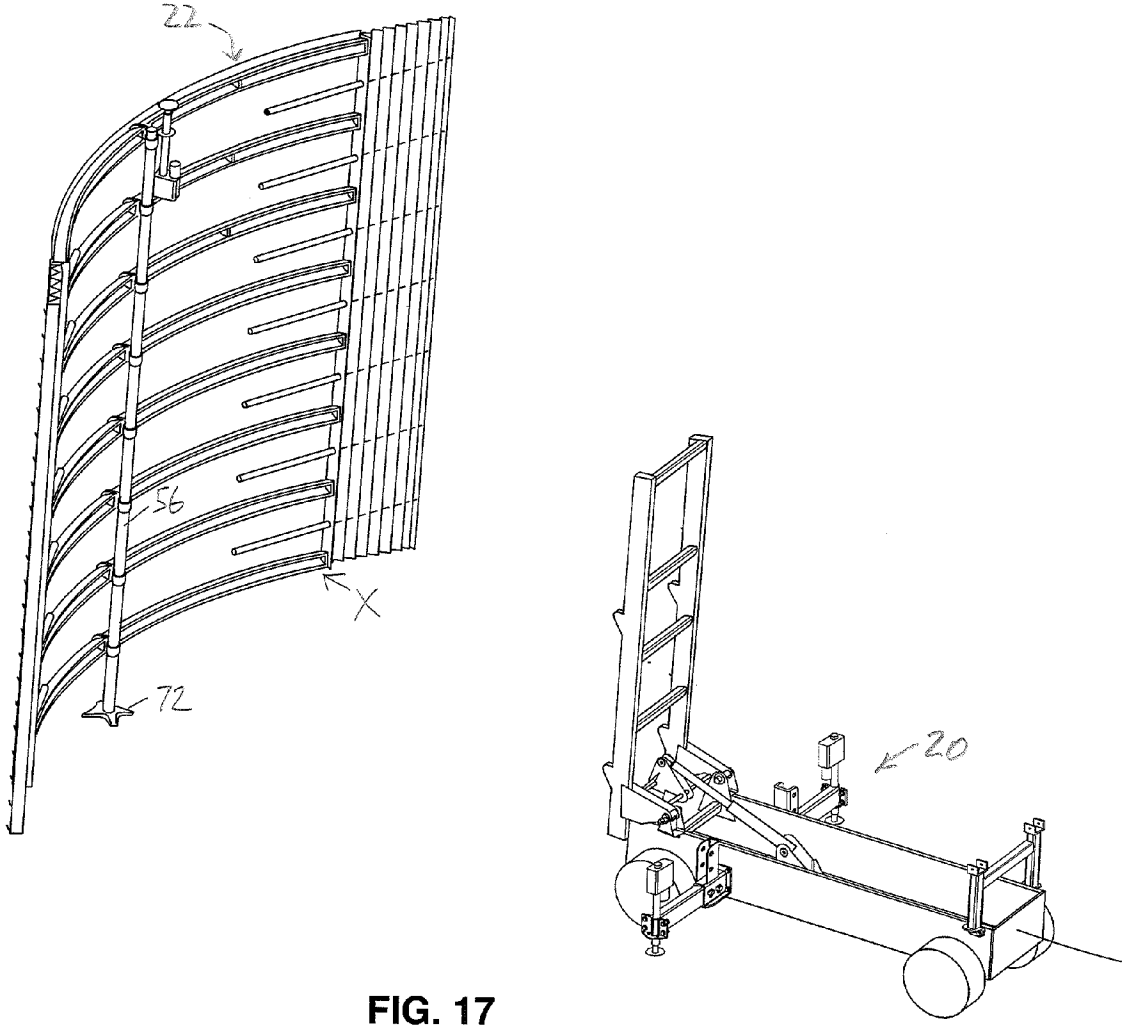
FIG. 17 is an isometric view of the fill fence installed in the preselected location and the carrier assembly further withdrawn from the predetermined location.

In the attached drawings, like reference numerals designate corresponding elements throughout. Reference is first made to FIGS. 1-21 to describe an embodiment of a carrier assembly of the invention indicated generally by the numeral 20. As will be described, the carrier assembly 20 is for at least partially installing a fill fence assembly 22 (FIGS. 10D, 17, 18) in a predetermined location "X" to at least partially cover an opening "Z" (FIG. 20A). In one embodiment, the carrier assembly 20 preferably includes a chassis subassembly 24 having a chassis 26 and a mast subassembly 30 to which the fill fence assembly 22 is securable (FIGS. 1-10D). Preferably, the mast subassembly 30 includes a mast frame 32 pivotably mounted to the chassis 26 and fastening elements 34 (FIGS. 1-2B) mounted on the mast frame 32. It is also preferred that the fastening elements 34 are configured for releasably securing one or more preselected portions 36 of the fill fence assembly 22 to the mast frame 32, as will also be described. In one embodiment, the carrier assembly 20 preferably also includes a lifting subassembly 38 for raising the mast frame 32, when the fill fence assembly 22 is secured to the mast frame 32, from a lowered position (FIGS. 1-11), in which the mast frame 32 is non-vertical, to a raised position (FIGS. 14A, 14B, 15) in which the mast frame 32 is non-horizontal, to position the fill fence assembly 22 in the predetermined location therefor.

As will also be described, in one embodiment, it is also preferred that the lifting subassembly 38 is additionally configured when the fill fence assembly 22 is secured to the mast frame 32, and for lowering the mast frame 32 from the raised position to the lowered position when the fastening elements 34 have released the preselected portions 36.

In one embodiment, the chassis subassembly 24 preferably includes a transportation subassembly 28, for moving the chassis 26 between an unsafe zone 40 proximal to the opening "Z" prior to installation of the fill fence assembly 22 to cover the opening "Z", and a safe zone 44 (FIG. 11) spaced apart from the opening "Z".

In one embodiment, the transportation subassembly 28 preferably includes wheels 39 suitably mounted to the chassis 26, for engagement with the floor "F" (FIG. 20A) to move the chassis 26 relative thereto. Preferably, the transportation subassembly 28 includes a suitable motor (not shown) operably connected with the wheels 39 by a suitable drive train (not shown). Those skilled in the art would be aware of suitable motors and drive trains. For example, in one embodiment, the transportation subassembly 28 may include two motors (i.e., one for each side of the unit), so that the carrier assembly 20 may be steered in a "skid steer" technique. In one embodiment, for instance, the carrier assembly 20 may include a chain drive and two air motors or electric motors, one motor for each side.

As will be described, in an alternative embodiment, the chassis subassembly may be provided without the transportation subassembly.

Figure 11:
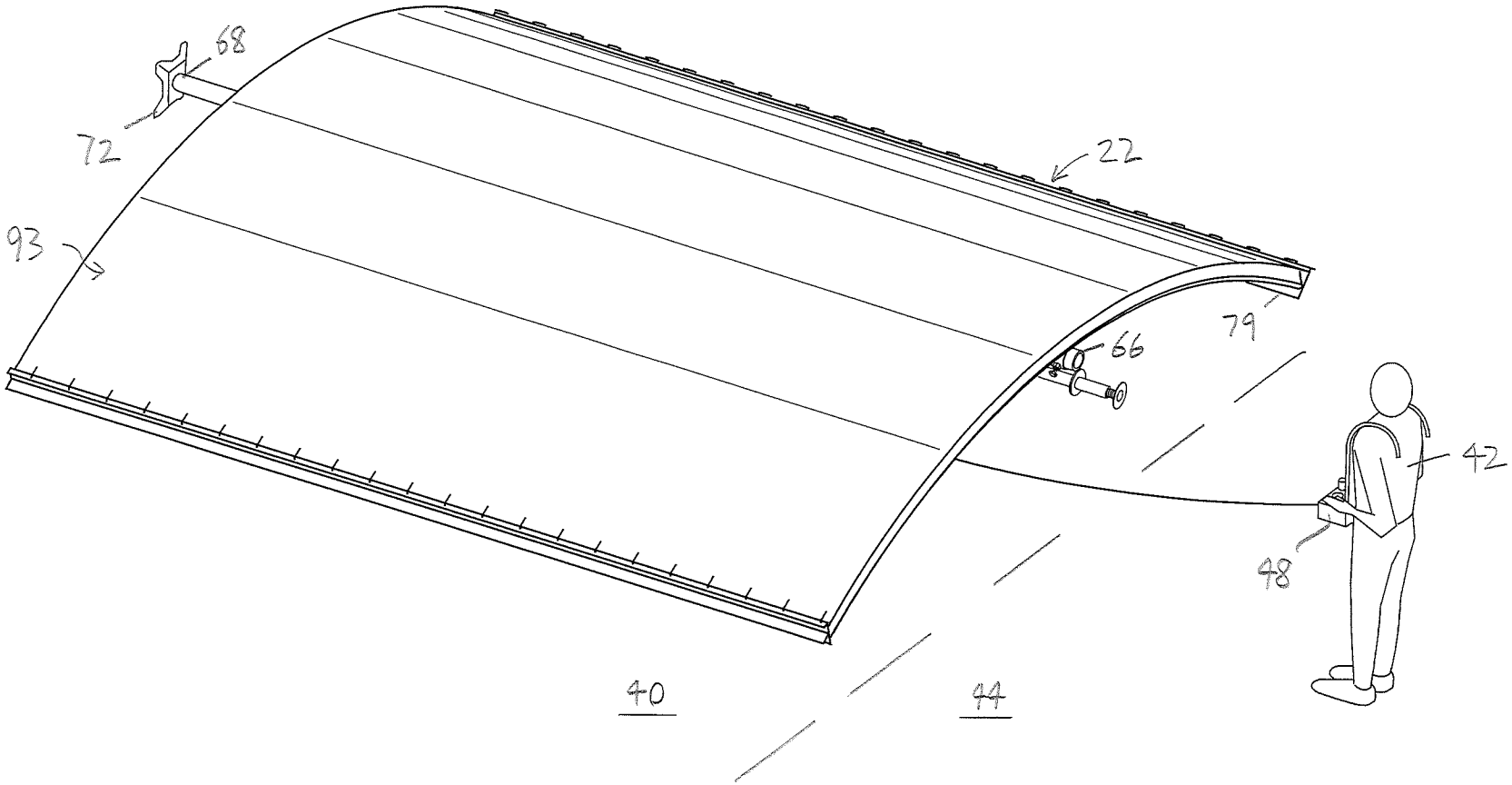
FIG. 11 is an isometric view of the system with the fill fence positioned on the carrier assembly, and the fill fence and the carrier assembly moving into an unsafe zone, drawn at a smaller scale.

As can be seen in FIG. 11, the chassis assembly 20 preferably is controllable in the unsafe zone 40 by an operator 42 who is located in the safe zone 44. Accordingly, an embodiment of the invention preferably includes a carrier system 46 (FIG. 12) that includes the carrier assembly 20 and a control unit 48 for remote control of the carrier assembly 20. Preferably, the control unit 48 is operably connected with one or more securing means 50 (FIGS. 12, 13) for securing the fill fence assembly 22 to a plurality of walls at a predetermined location "X", to control the securing means 50. It is also preferred that, via the control unit 48, the operator 42 may control the securing means 50 of the fill fence assembly 22, as will also be described in more detail below.

Preferably, the control unit 48 is also operably connected with the transportation subassembly 28, for controlling movement of the carrier assembly 20 between the safe zone 44 and the unsafe zone 40.

Figure 21:
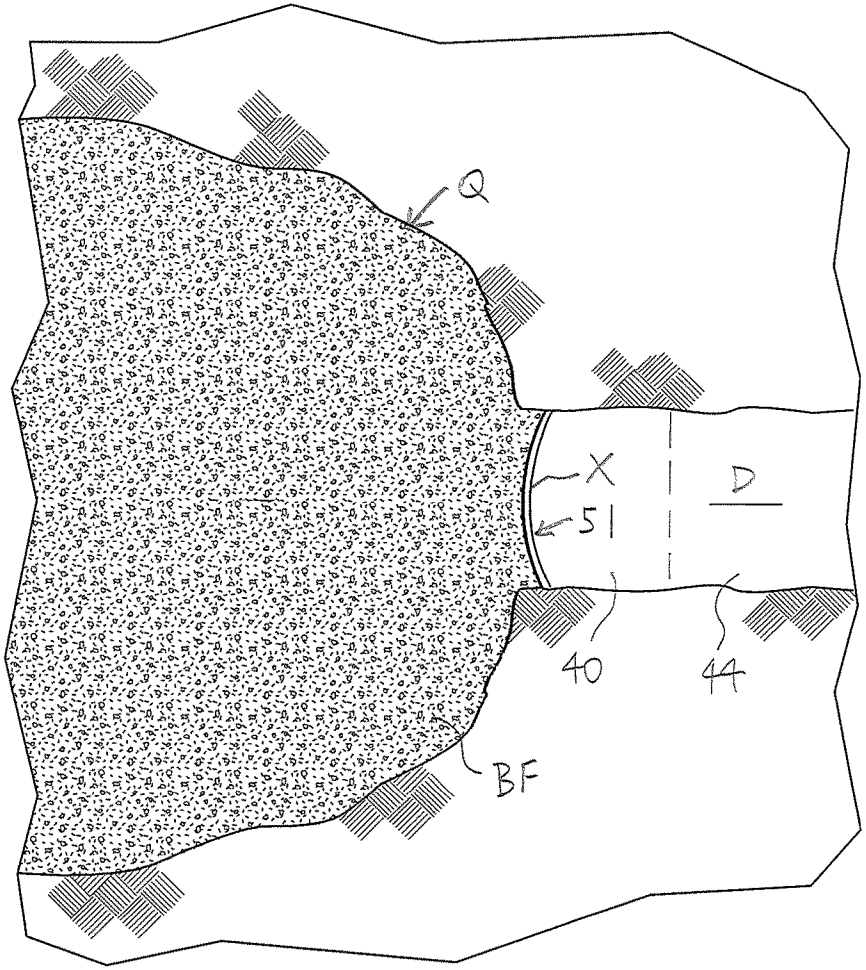
FIG. 21 is a cross-section in plan view of the fill fence system of FIG. 20B, drawn at a smaller scale.

As will be described, the predetermined location "X" preferably is in a drift "D" and proximal to an entrance (i.e., the opening "Z") to a mined-out region "R" into which backfill "BF" is to be located (FIG. 21).

It will be understood that, for the purposes hereof, "non-horizontal" preferably means substantially, or approximately, vertical. Also, it will be understood that "non-vertical" preferably means substantially, or approximately, horizontal. For instance, as will be described, it is preferred that the fill fence assembly 22 is positioned substantially vertically in the predetermined location "X", before the fill fence assembly 22 is secured to the walls, the back, and the floor that define the opening "Z". However, those skilled in the art would appreciate that the fill fence assembly 22 may be positioned at any other suitable non-horizontal orientation when it is secured in the opening "Z". Similarly, although it is preferred that the mast frame 32 is substantially horizontal when the elements of the fill fence assembly 22 are assembled on it to form the fill fence assembly 22, those skilled in the art would appreciate that the mast frame 32 may be in any suitable non-vertical position while the elements of the fill fence assembly 22 are assembled on it.

Figure 5:
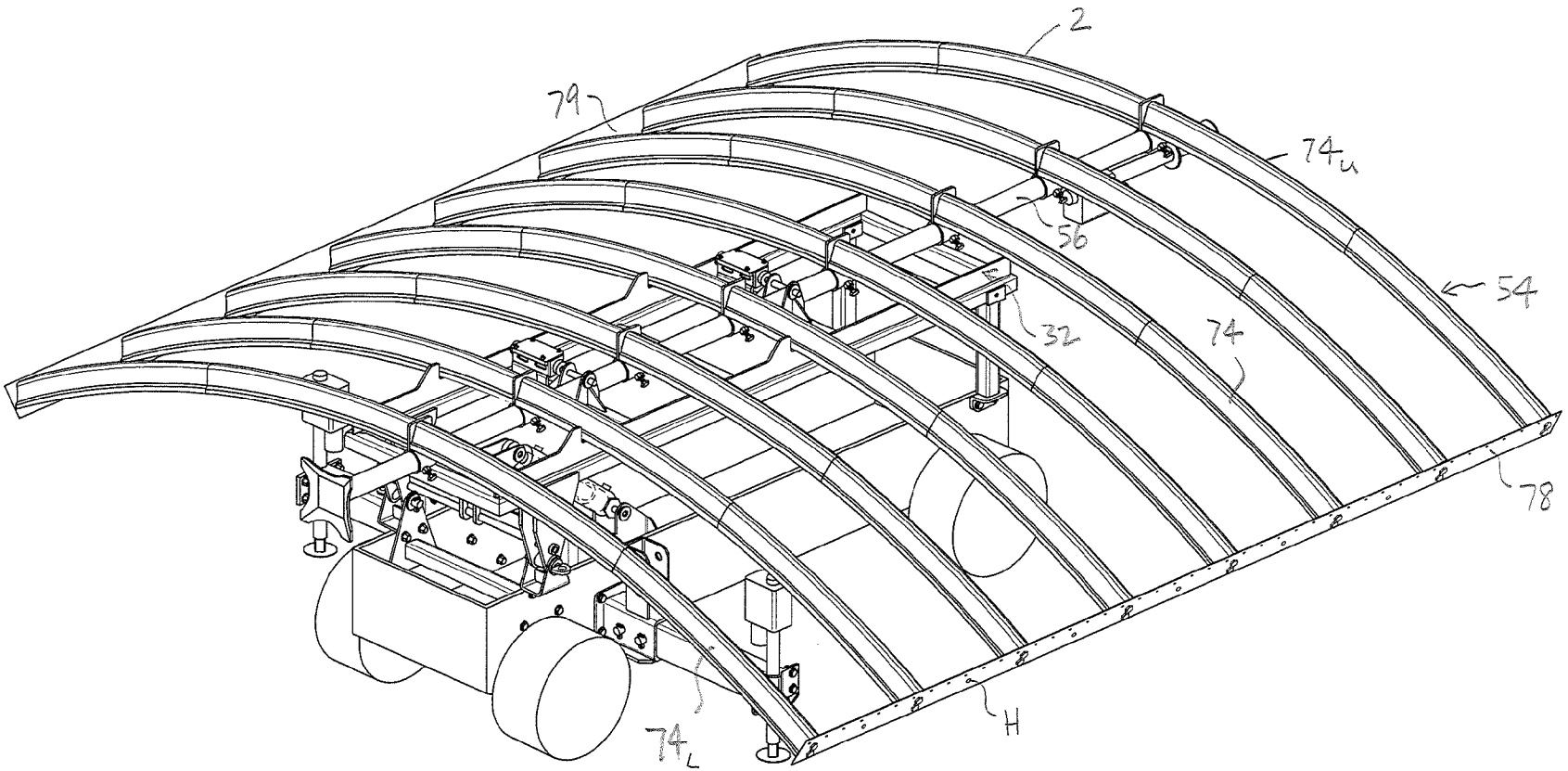
FIG. 5 is an isometric view of the cross-members and central post of FIG. 4 with side plates secured at the ends of the cross-members.

As will also be described, the fill fence assembly 22 preferably includes a body subassembly 54 (FIGS. 5, 20A). The fill fence assembly 22, when located in the predetermined location "X" therefor and secured to the back "B", the floor "F", and left and right side walls, "LW", "RW" is illustrated in FIG. 20A. As will be described, once the fill fence assembly 22 is secured to the back, the floor, and the side walls ("B", "F", "LW", "RW"), a number of gaps are defined between the body subassembly 54 of the installed fill fence assembly 22 and each of the back "B", the floor "F", and the left and right side walls "LW", "RW". Accordingly, and as can be seen in FIG. 20B, an embodiment of a fill fence system 51 of the invention preferably includes a securing element (preferably, concrete) 52 positioned to at least partially cover such gaps.

Figure 20A:
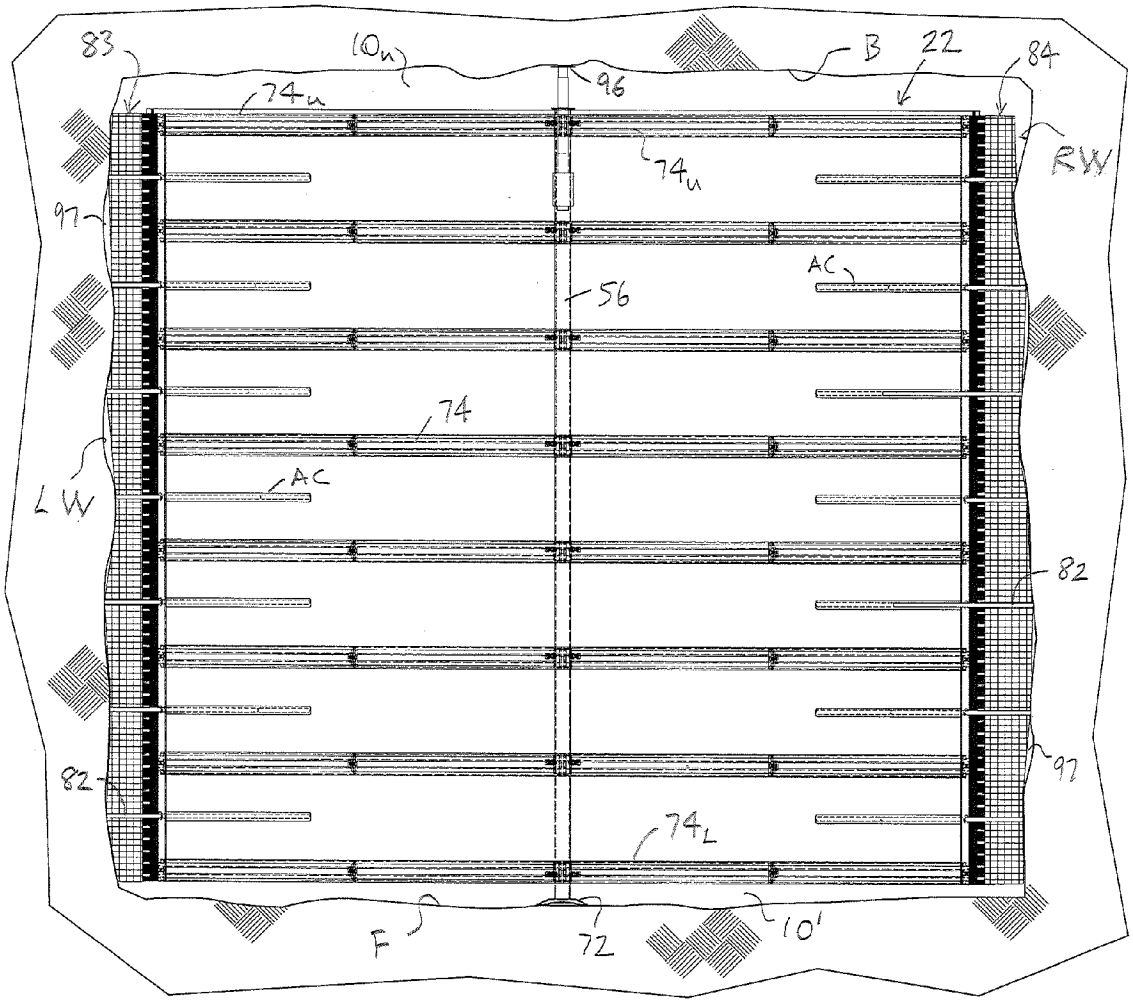
FIG. 20A is an elevation view of the fill fence installed in the preselected location, drawn at a larger scale.
Figure 20B:
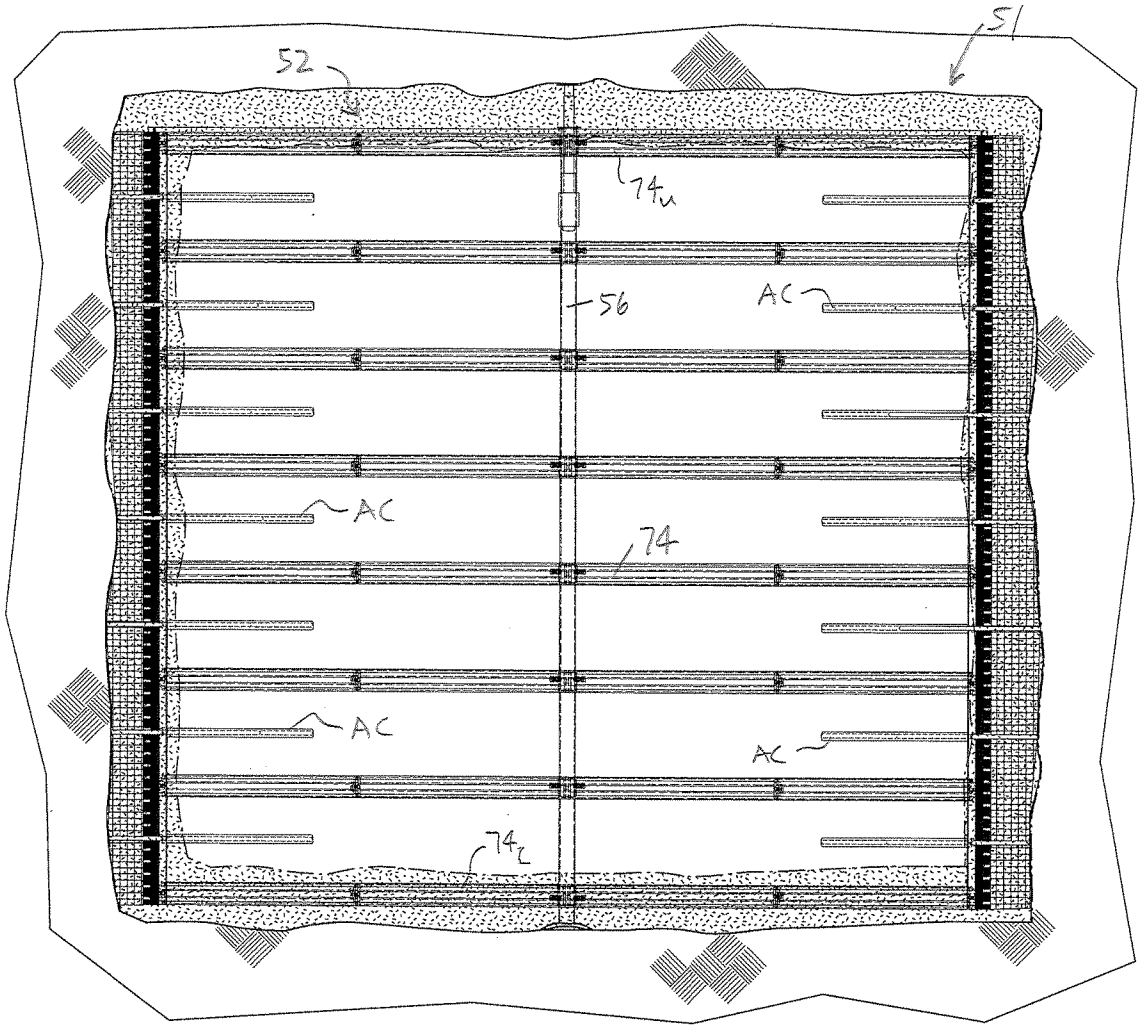
FIG. 20B is an elevation view of the installed fill fence of FIG. 20A to which shotcrete has been applied, to form a fill fence system.

As can be seen in FIG. 20B, the fill fence system 51 is for substantially covering the opening "Z" that is in communication with an open stope (or other open region) "Q" when the fill fence system 51 is located in the predetermined location. The opening "Z" is defined by the back "B", the opposed floor "F", and opposing left and right walls "LW", "RW". In one embodiment, the fill fence system 51 preferably includes the fill fence assembly 22.

Those skilled in the art would appreciate that the concrete 52 preferably is delivered in the form of shotcrete. It will be understood that materials other than concrete may be suitable securing elements. As will be described, the concrete 52 preferably is used to at least partially cover the gaps between the installed fill fence assembly 22 and the walls of the drift (including the back and the floor) that define the opening "Z", and to help secure the fill fence assembly 22 in the opening "Z". It will be understood that the securing material 52, if concrete (shotcrete), is to be allowed to cure. Those skilled in the art would appreciate that any material that could cover such gaps and secure the fill fence assembly 22 to the side walls, the back, and the floor, may be suitable.

As can also be seen in FIGS. 20A and 20B, the concrete or other securing material 52 preferably is located around a periphery of the body subassembly 54 of the installed fill fence assembly 22. Those skilled in the art would appreciate that the shotcrete, once cured, helps to secure the fill fence assembly 22 in the opening "Z". The fill fence assembly 22 preferably includes one or more membranes 93 (not shown in FIGS. 20A and 20B) that are congruent, or substantially congruent, with the body subassembly 54. Depending on the intended functions of the fill fence assembly 22, the membrane 93 may be permeable (e.g., water-permeable), or impermeable, as will be described.

In most cases, the fill fence system 51 is formed to hold backfill "BF" in an open stope or other mined-out region (FIG. 21). Those skilled in the art would appreciate that the backfill "BF" when first introduced into the mined-out region "Q" typically includes a substantial amount of water (as well as fine waste rock), and over time, much of the water drains from the backfill, under the influence of gravity. In most cases, it is desirable that water from the backfill "BF" is allowed to pass through the membrane 93, to reduce the hydrostatic pressure exerted on the fill fence system 51 over time.

However, it will be understood that the fill fence system 51 may be installed to cover the opening "Z" for other purposes, e.g., for ventilation control. Those skilled in the art would appreciate that, where required, the membrane 93 accordingly may be impermeable (or substantially impermeable), rather than permeable.

It will also be understood that the fill fence system 51 may, in certain circumstances, be intended to retain backfill in a mined-out region, but not permit water from the backfill to pass therethrough. In this situation also, the membrane 93 preferably is impermeable (or substantially impermeable). Those skilled in the art would also appreciate that, in an installation where the membrane is at least substantially impermeable, the securing material 52 may also be formed so that it is impermeable, or substantially impermeable, e.g., via a waterproofing treatment of the securing material 52.

In a fill fence system 51 in which the membrane 93 is permeable, it will be understood that water may pass through the membrane 93 (not shown in FIGS. 20A, 20B), which is substantially congruent with the body subassembly 54, as will be described.

It is preferred that the body subassembly 54 has an inner side 2 (FIG. 5) formed to be facing toward the open stope or other mined-out region "Q" (FIG. 21) and an outer side 4 (FIG. 13) formed to be facing away from the open stope "Q", when the fill fence assembly 22 is installed in the predetermined location "X". Preferably, and as can be seen in FIG. 5, the body subassembly 54 includes a central post 56 and a number of cross-members 74 mounted to the central post 56. Each cross-member 74 extends between left and right ends "L", "R" thereof. The cross-members 74 include an uppermost cross-member $\mathbf{74}_U$ positioned to be located uppermost when the fill fence assembly 22 is installed in the predetermined location "X", and a lowermost cross-member $\mathbf{74}_L$ positioned to be located lowermost when the fill fence assembly 22 is installed in the predetermined location "X". It is also preferred that the body subassembly 54 includes a left side plate 78 and a right side plate 79, mounted to the left and right ends "L", "R" of the cross-members 74 respectively (FIG. 5).

Figure 9A:
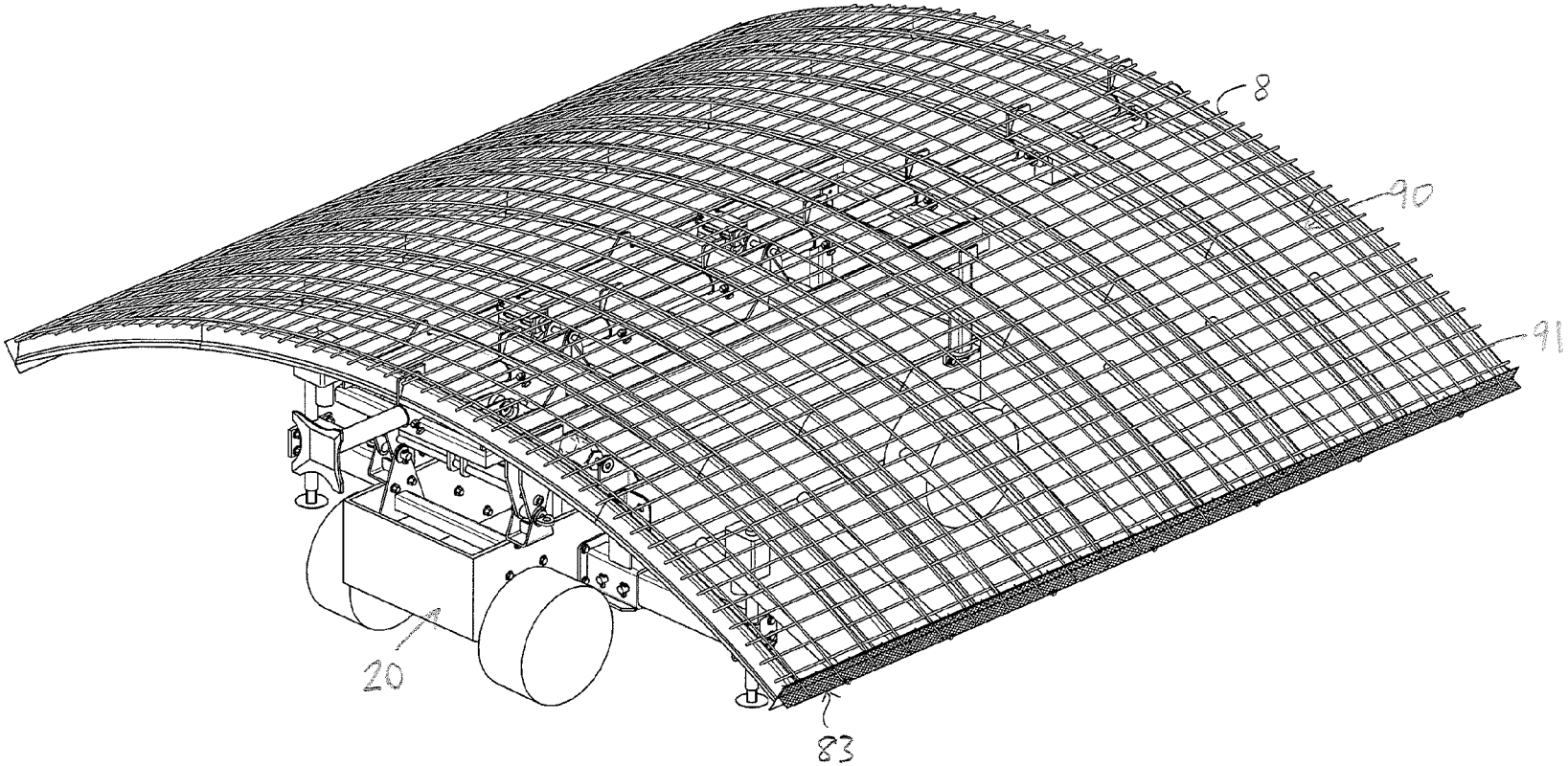
FIG. 9A is an isometric view of a screen positioned on the cross-members mounted to the central post, drawn at a smaller scale.
Figure 10A:
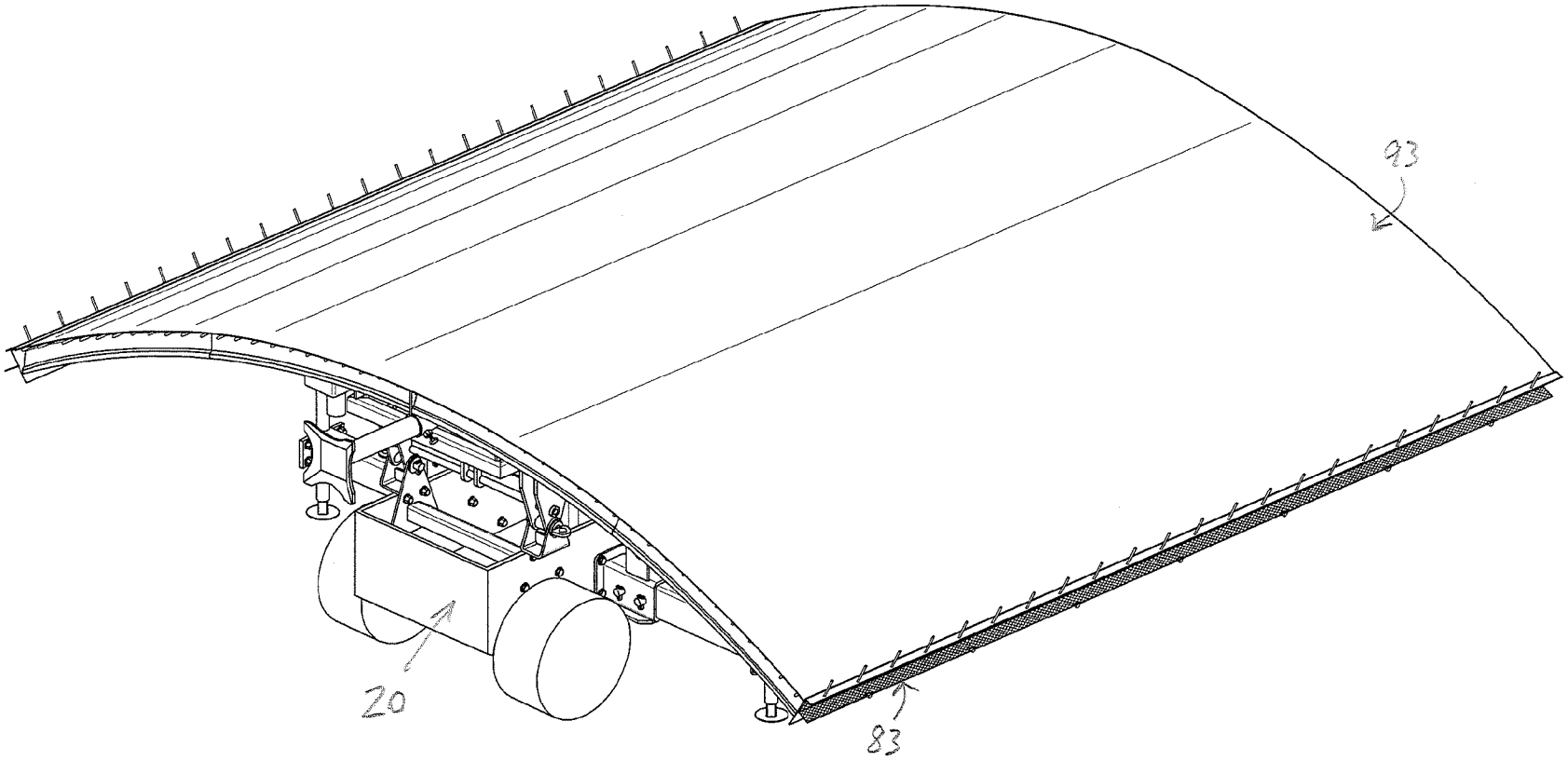
FIG. 10A is an isometric view of a geotextile fabric sheet covering the screen of FIG. 9A, drawn at a smaller scale.

The fill fence assembly 22 preferably includes one or more screens 90 positioned on the inner side 2 of the body subassembly 54 (FIG. 9A), the screen 90 including an exterior side at least partially engaged with the inner side 2 of the body subassembly 54, and an interior side 8 (FIG. 9A) positioned to face toward the open stope "Q" when the fill fence assembly 22 is installed in the predetermined location "X". As can be seen in FIG. 9A, when the fill fence assembly 22 is being assembled, the screen 90 preferably is positioned on the body subassembly 54 with its exterior side facing downwardly and the interior side 8 facing upwardly. As will be described, after the screen 90 is positioned on the body subassembly 54, it is secured to the body subassembly. The fill fence assembly 22 also preferably includes one or more membranes 93 positioned on the interior side 8 of the screen 90 (FIG. 10A). As can be seen in FIGS. 9A and 10A, when the fill fence assembly 22 is being assembled, the membrane 93 preferably is laid down onto the interior side 8 of the screen 90. After the membrane 93 is positioned on the screen 90, it is secured to the screen 90 and the body subassembly 54, as will also be described.

As can be seen in FIGS. 6-8B, the fill fence assembly 22 preferably includes a number of air cylinder subassemblies 80 mounted to the left and right side plates 78, 79 respectively. Each air cylinder subassembly 80 preferably includes an air cylinder "AC" and a rebar element 82, the air cylinder being activatable to extend the rebar element 82 away from the central post 56 to an extended position thereof. The rebar elements 82 can be seen in their, respective extended positions in FIGS. 14C, 20A, and 20B. Outer ends of the extended rebar elements 82 are identified in FIG. 14C by reference character 88 for convenience.

It is also preferred that the fill fence assembly 22 includes left and right expandable mesh elements 83, 84. The expandable mesh element 84 is not shown in its contracted condition for clarity of illustration. It is preferred that the expandable mesh elements 83, 84 are in contracted condition (i.e., prior to their expansion) when they are installed, to be included in the fill fence assembly. The expandable mesh element 83 is shown in the contracted condition thereof in FIGS. 7A-10D. It will be understood that the expandable mesh element 84, in its contracted condition, is assembled into the fill fence assembly 22 in the same way as the expandable mesh element 83.

Figure 7A:
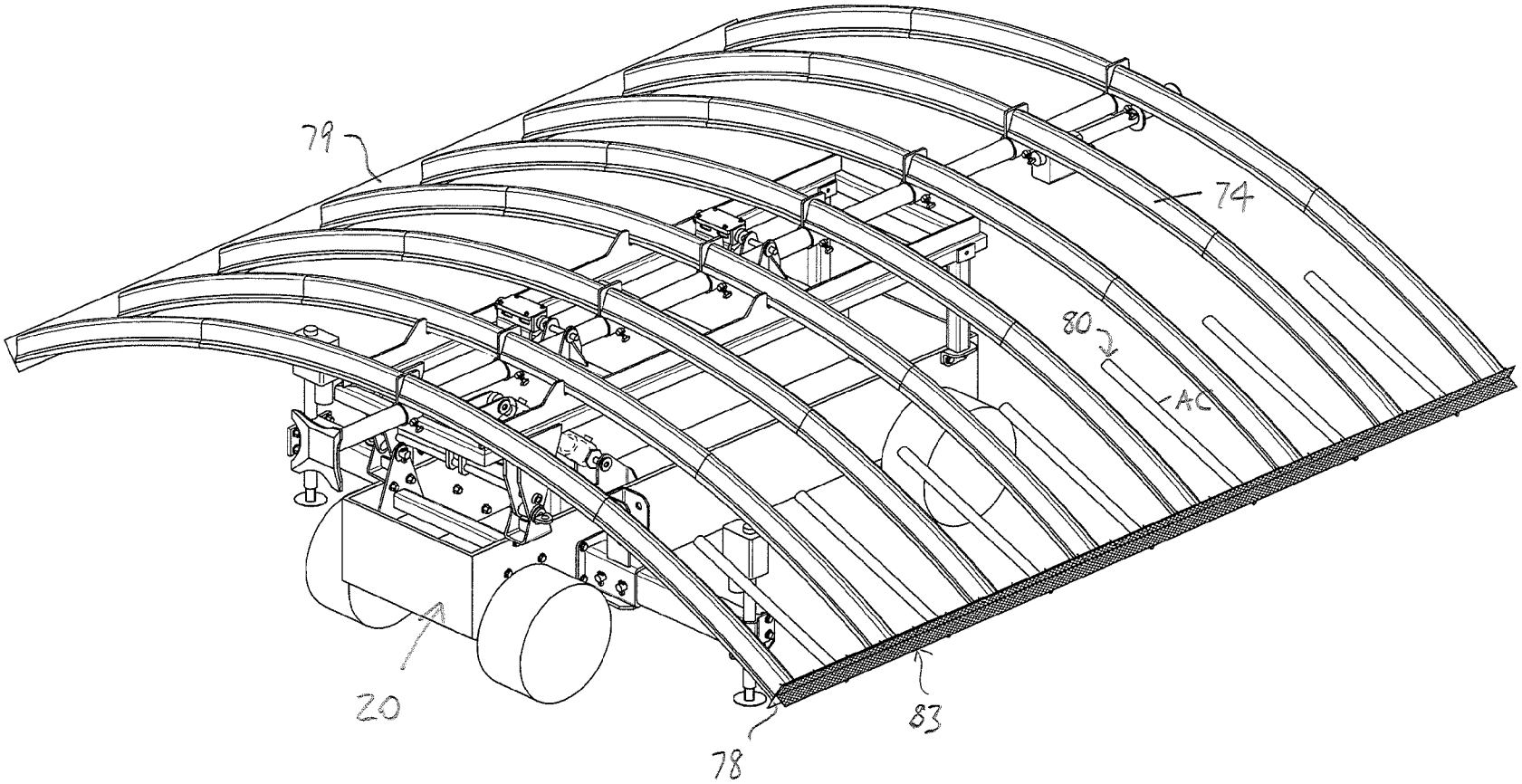
FIG. 7A is an isometric view of the cross-members and other elements of the fill fence of FIG. 6 with an inner side of a section of an expandable mesh element attached to the side plates.
Figure 7B:
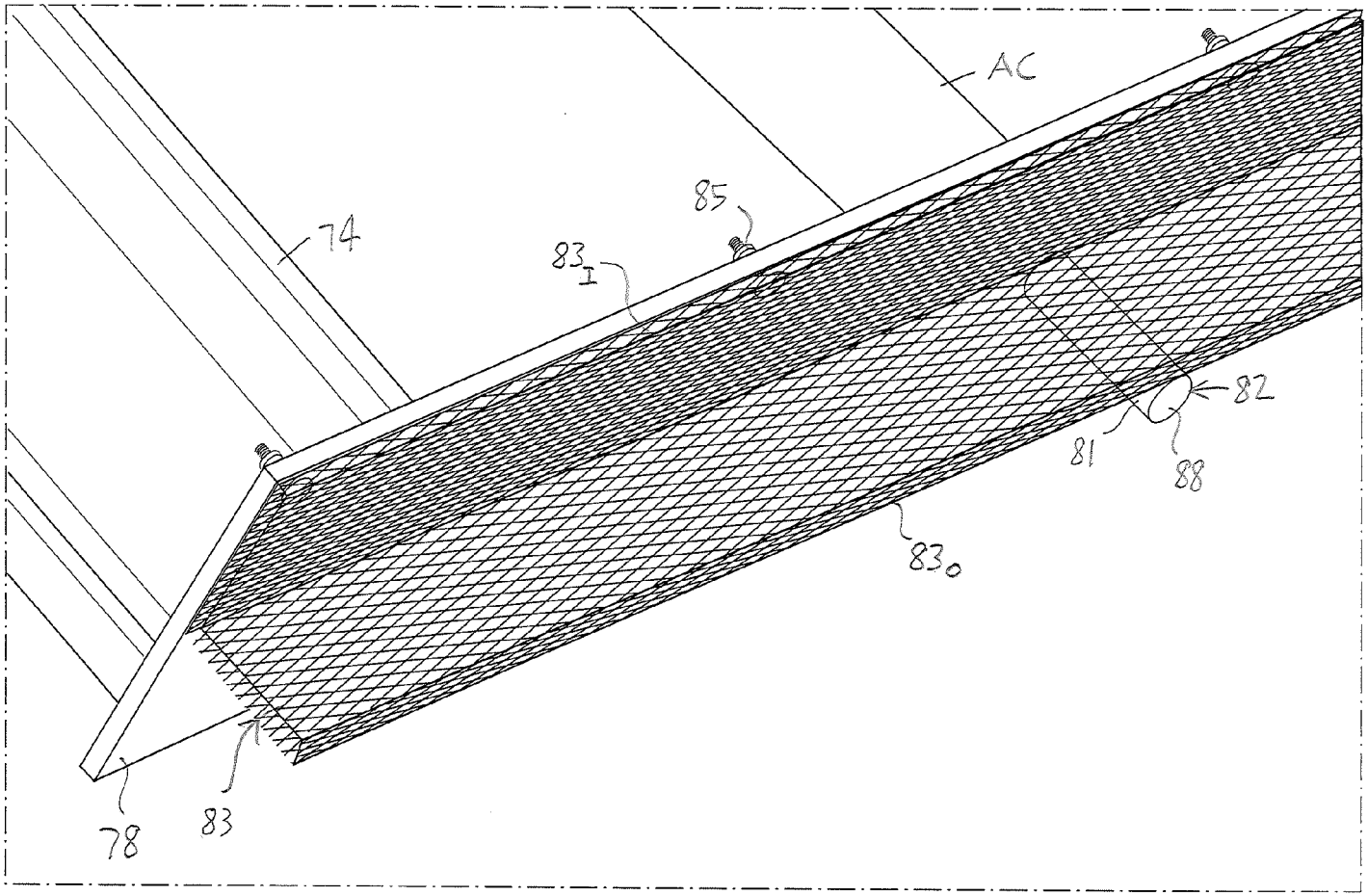
FIG. 7B is an isometric view of a portion of the section of the expandable mesh element of FIG. 7A and an air cylinder subassembly, drawn at a larger scale.

The left expandable mesh element 83 extends between an inner side $\mathbf{83}_I$ thereof secured to the left side plate 78 and an outer side $\mathbf{83}_O$ thereof secured to respective outer ends 88 of the rebar elements 82 positioned proximal to the left side plate 78 (FIG. 7B). The right expandable mesh element 84 extends between an inner side $\mathbf{84}_I$ thereof secured to the right side plate 79 and an outer side $\mathbf{84}_O$ thereof secured to respective outer ends 88 of the rebar elements 82 (FIG. 14C).

From the foregoing, it can be seen that, when the fill fence assembly 22 is in the predetermined location "X", the central post 56 is positioned in a non-horizontal position (preferably, vertical, or substantially vertical) between the back "B" and the floor "F", to locate the cross-members 74 in non-vertical positions (preferably, horizontal, or substantially horizontal) respectively, to locate the left and right ends "L", "R" of the cross-members proximal to the left and right walls "LW", "RW" respectively (FIG. 20A).

When the fill fence assembly 22 is in the predetermined location "X", the left and right side plates 78, 79 define respective left side and right side gaps $\mathbf{10}_L$, $\mathbf{10}_R$ between the left side plate 78 and the left wall "LW", and between the right side plate 79 and the right wall "RW". Upon activation of the air cylinders "AC", the outer ends 88 of the rebar elements 82 are extended to engage the left and right walls "LW", "RW" respectively, to expand the left and right expandable mesh elements 83, 84 at least partially over the left side gap and the right side gap $\mathbf{10}_L$, $\mathbf{10}_R$ respectively. Once so expanded, the expandable mesh elements 83, 84 are in their respective expanded conditions.

As can be seen in FIG. 20A, when the fill fence assembly 22 is in the predetermined location "X" and secured to the back, the floor, and the side walls, the uppermost cross-member $\mathbf{74}_U$ defines an upper gap $\mathbf{10}_U$ between the uppermost cross-member $\mathbf{74}_U$ and the back "B", and the lowermost cross-member $\mathbf{74}_L$ defines a lower gap 10' between the lowermost cross-member $\mathbf{74}_L$ and the floor "F". Preferably, the fill fence system 51 additionally includes the concrete 52 at least partially covering the upper gap $\mathbf{10}_U$, the lower gap 10', and the left and right side gaps $\mathbf{10}_L$, $\mathbf{10}_R$.

As noted above, the concrete 52 preferably is provided in the form of shotcrete. It will be understood that, as illustrated in FIGS. 20A and 20B, the concrete that at least partially covers the left and right side gaps $\mathbf{10}_L$, $\mathbf{10}_R$ is at least partially supported by the left and right expandable mesh elements 83, 84 respectively. Those skilled in the art would appreciate that, once the left and right expandable mesh elements 83, 84 are in their expanded conditions, holes therein preferably are sufficiently small that the expanded mesh elements 83, 84 support the shotcrete 52 sprayed thereon (FIG. 20B). Those skilled in the art would also be aware of the techniques that may be employed to use the shotcrete to cover the parts of the gaps $\mathbf{10}_L$, $\mathbf{10}_R$ not covered by the expandable mesh 78, 79. Those skilled in the art would also be aware that such techniques may also be employed to use the shotcrete to cover the upper gap $\mathbf{10}_U$ and the lower gap 10'.

The invention also includes a method of installing the fill fence system 51 at the predetermined location "X" to cover the opening "Z". In one embodiment, the method preferably includes providing the carrier system 46, and locating the carrier assembly 20 in the safe zone 44. It is preferred that, with the mast frame 32 in the lowered position, one or more preselected portions 36 of the body subassembly 54 of the fill fence assembly 22 are positioned on the mast frame 32. Next, the preselected portions 36 are secured to the mast frame 32 by the fastening elements 34.

Figure 12:
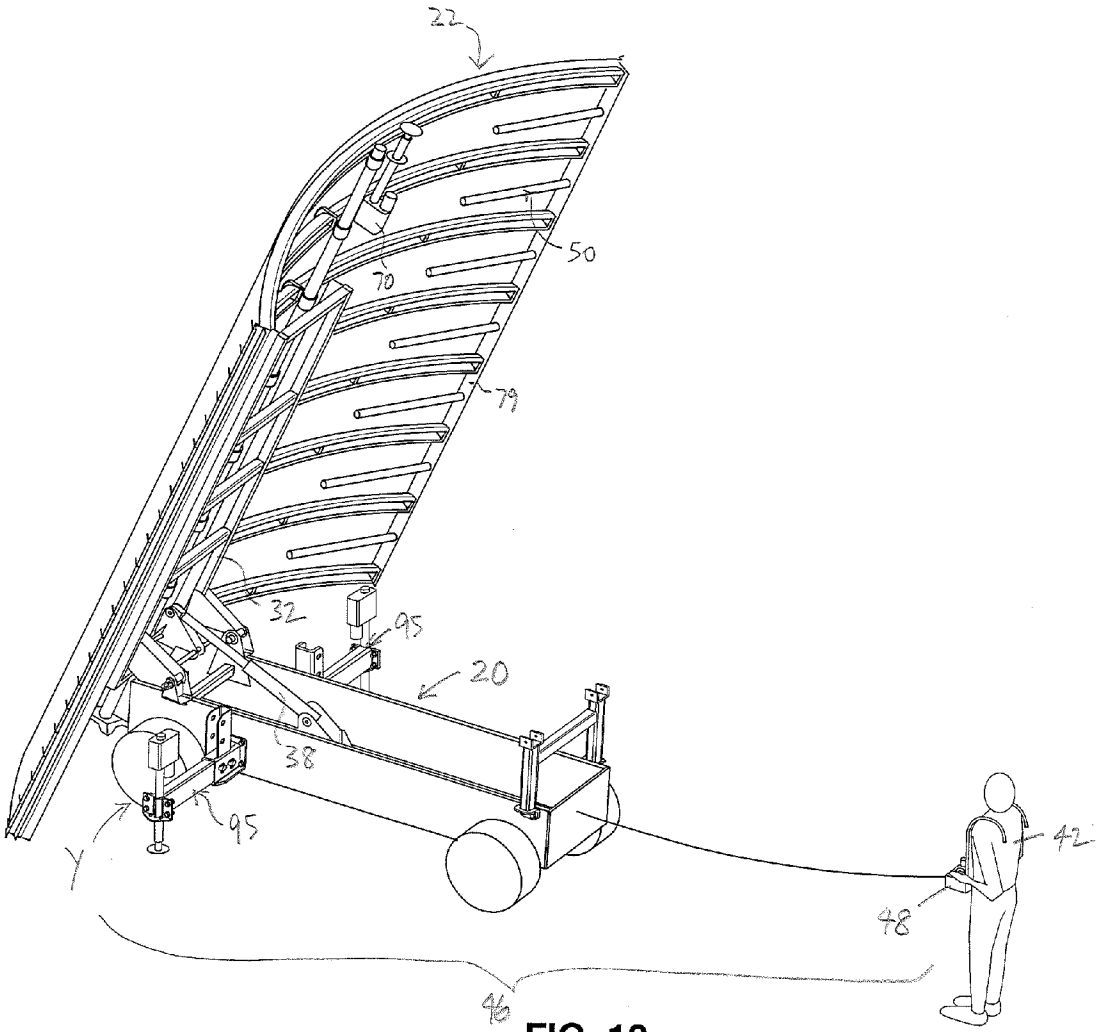
FIG. 12 is an isometric view in which the mast frame is between its lowered position and its raised position, with the carrier assembly being at a predetermined location in the unsafe zone.
Figure 13:
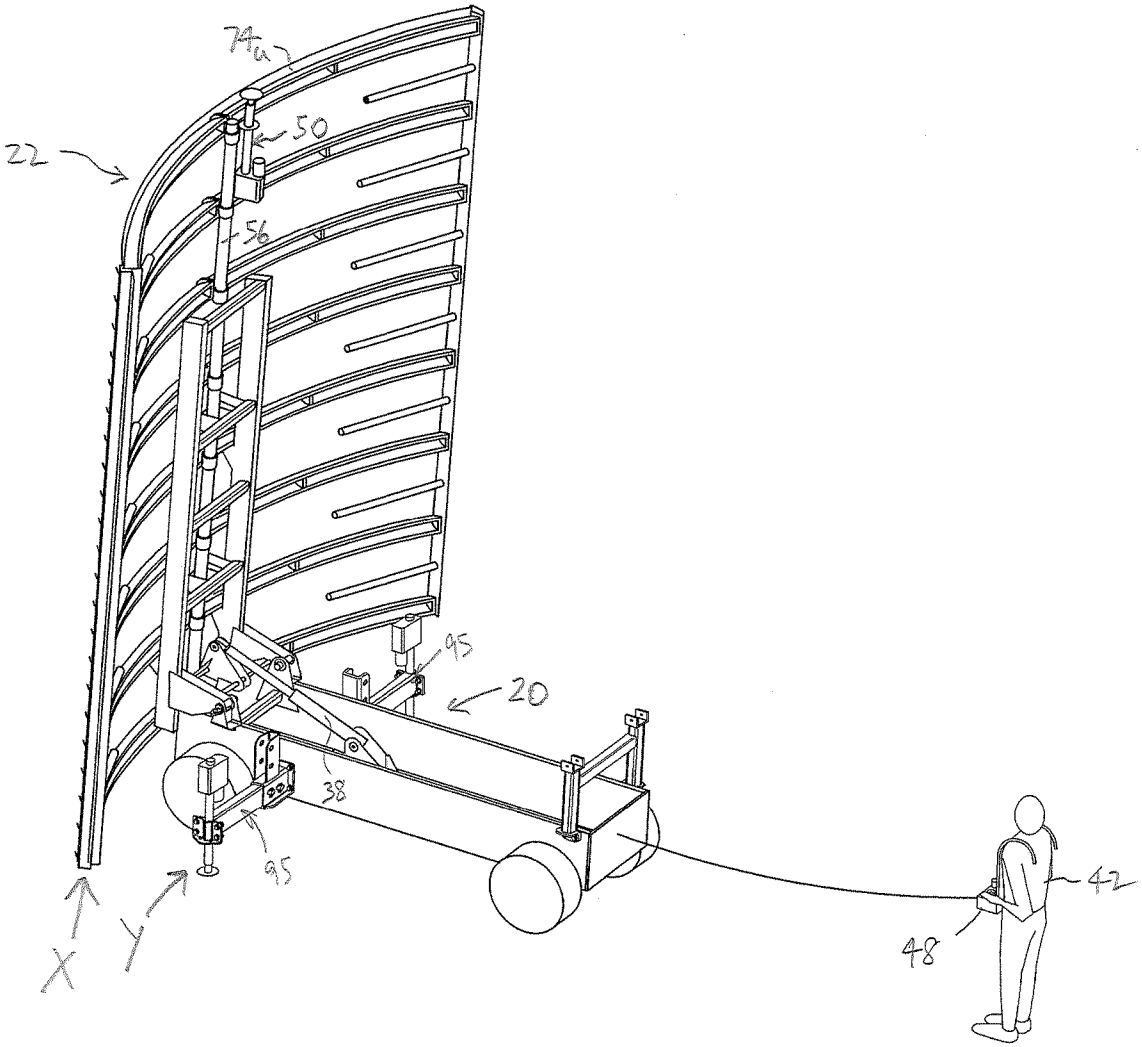
FIG. 13 is an isometric view of the mast frame of FIG. 12 in a further raised position.

With the fill fence assembly 22 secured to the mast frame 32, the carrier assembly 20 is moved from the safe zone 44 to a preselected location "Y" therefor in the unsafe zone 40 (FIG. 12) from which the fill fence assembly 22 may be positioned in the predetermined location "X" therefor by the carrier system 46. With the carrier assembly 20 at the preselected location "Y", the mast frame 32 is raised to the raised position, to position the fill fence assembly 22 in the predetermined location "X" therefor (FIG. 13). As can be seen, e.g., in FIG. 13, it is preferred that, when the fill fence assembly 22 is in the predetermined location "X" therefor, the fill fence assembly 22 preferably is in a non-horizontal position (i.e., positioned vertically, or substantially vertically). It is also preferred that, via the control unit 48, the securing means 50 are activated, to secure the fill fence assembly 22 in a non-horizontal position to at least the walls of the drift "D" in the predetermined location "X", i.e., to the back "B", the floor "F", and the left and right side walls "LW", "RW", to define the gaps $\mathbf{10}_U$, $\mathbf{10}_L$, $\mathbf{10}_R$, and 10'. Next, the preselected portions 36 of the fill fence assembly 22 preferably are released from the mast frame 32, by releasing the fastening elements 34 therefrom. The mast frame 32 is moved to the lowered position, i.e., to a non-vertical (e.g., substantially horizontal) position. Finally, the carrier assembly 20 is moved from the unsafe zone 40 to the safe zone 44.

In one embodiment, the method of the invention preferably also includes applying the shotcrete 52 (FIG. 20B) to at least partially cover the gaps between the body subassembly 54 and the back "B", the floor "F", and the left and right side walls "LW", "RW", to provide the fill fence system 51. It will be understood that the installed fill fence assembly 22, with the shotcrete 52 applied thereto (illustrated in FIG. 20B), is referred to as the fill fence system 51 (FIGS. 20B, 21).

As will be described, in an alternative embodiment, the shotcrete 52 may be applied, at least in part, before the preselected portions 36 are released from the mast frame 32.

The fill fence system 51 is illustrated in FIG. 20B and FIG. 21. (It will be understood that certain elements of the fill fence system 51 are omitted from FIGS. 20A and 20B for clarity of illustration.) As can be seen in FIGS. 20A and 20B, the fill fence system 51 preferably provides a substantially sealed barrier around the body subassembly 54 because the shotcrete 52 forms a seal between the body subassembly 54 and each of the back "B", the side walls "LW", "RW", and the floor "F". As can be seen in FIG. 21, the fill fence system 51 may be positioned in the drift "D" at an entrance to the mined-out region "Q". In FIG. 21, the fill fence system 51 is shown holding backfill "BF" in position in the mined-out region "Q".

As will be described, because the membrane 93 is permeable, it permits water draining from the backfill to pass therethrough, except to the extent that the membrane 93 may be partially covered by the shotcrete 52.

As can be seen in FIGS. 1-10D, it is preferred that the fill fence assembly 22 is assembled on the chassis assembly 24 in the safe zone 44, when the mast frame 32 is in the lowered position. The fill fence assembly 22 preferably includes the central post 56. As can be seen in FIG. 2A, the central post 56 preferably is positioned on the mast frame 32, when the mast frame 32 is in the lowered position, and secured to the mast frame 32 by the fastening elements 34.

Figure 1:
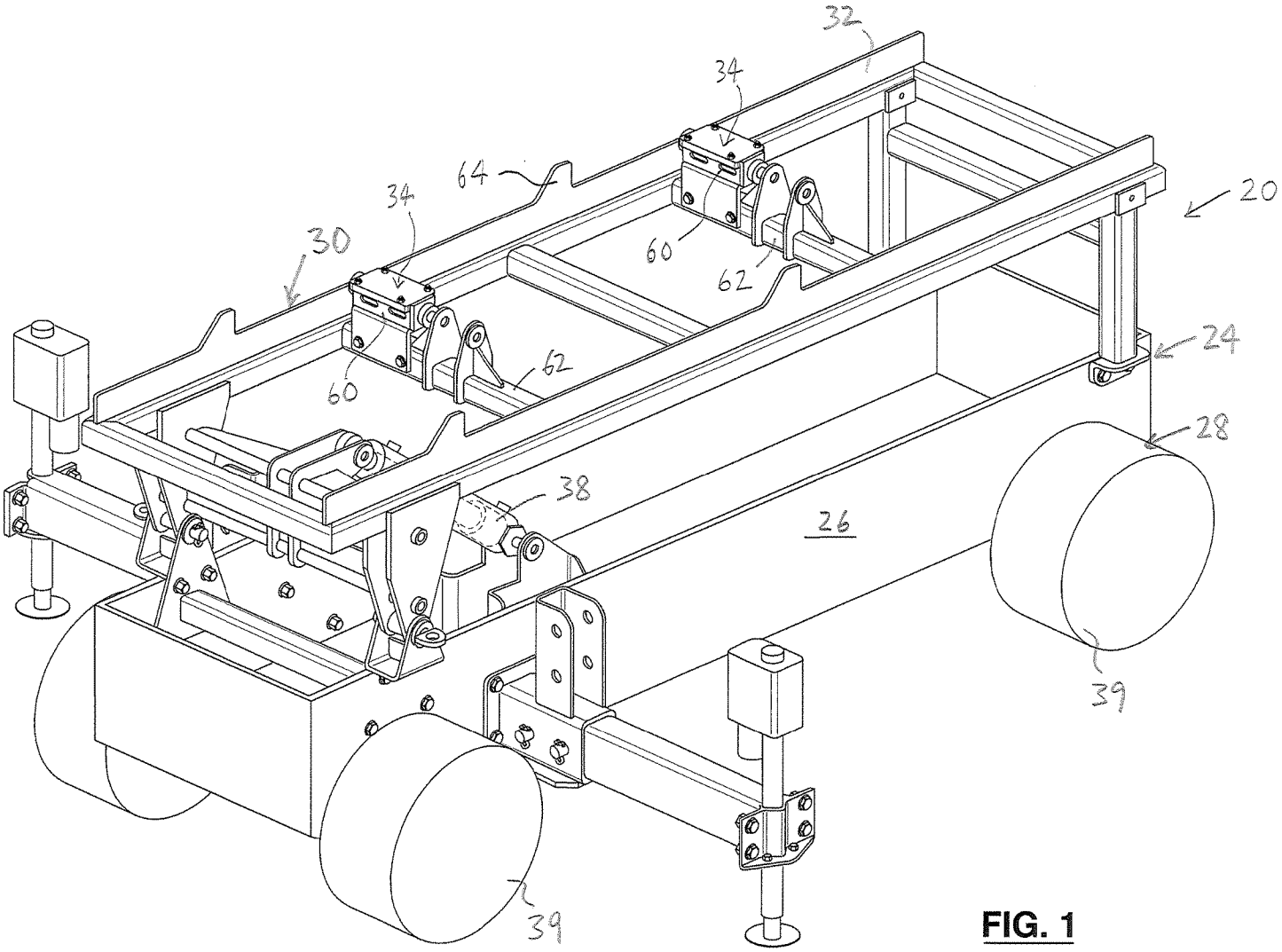
FIG. 1 is an isometric view of an embodiment of a carrier assembly of the invention.

Any suitable fastening devices may be used as the fastening elements 34. In one embodiment, the fastening elements 34 preferably include pins 58 that are respectively mounted in hydraulic cylinder units 60, so that the pins 58 are movable between retracted positions (FIGS. 1, 2A) and extended positions (FIG. 2B). As will be described, in one embodiment the movement of the pins 58 from the extended positions to the retracted positions thereof, to release the central post 56 from the fastening elements 34, preferably is remotely controllable.

It will be understood that the carrier assembly 20 may be used to carry and to install a fill fence, or another structure, other than the fill fence assembly 22 described herein. In addition, the carrier assembly 20 may be used to carry a structure (e.g., not necessarily a fill fence) and then to raise the structure to a non-horizontal position, e.g., to a substantially vertical position.

Figure 2A:
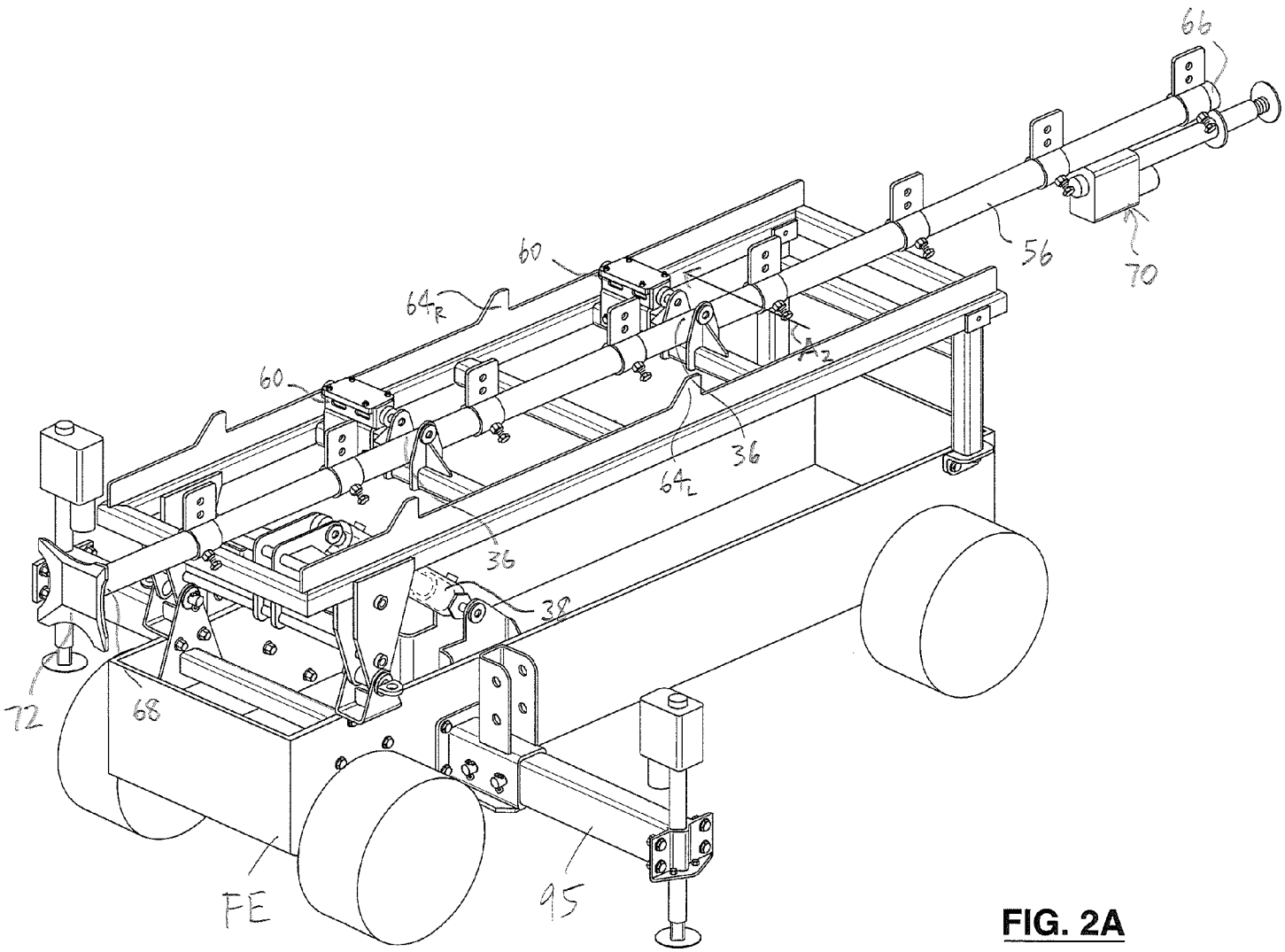
FIG. 2A is an isometric view of the carrier assembly of FIG. 1 with a central post of a fill fence positioned on a lowered mast frame of the carrier assembly.
Figure 2B:
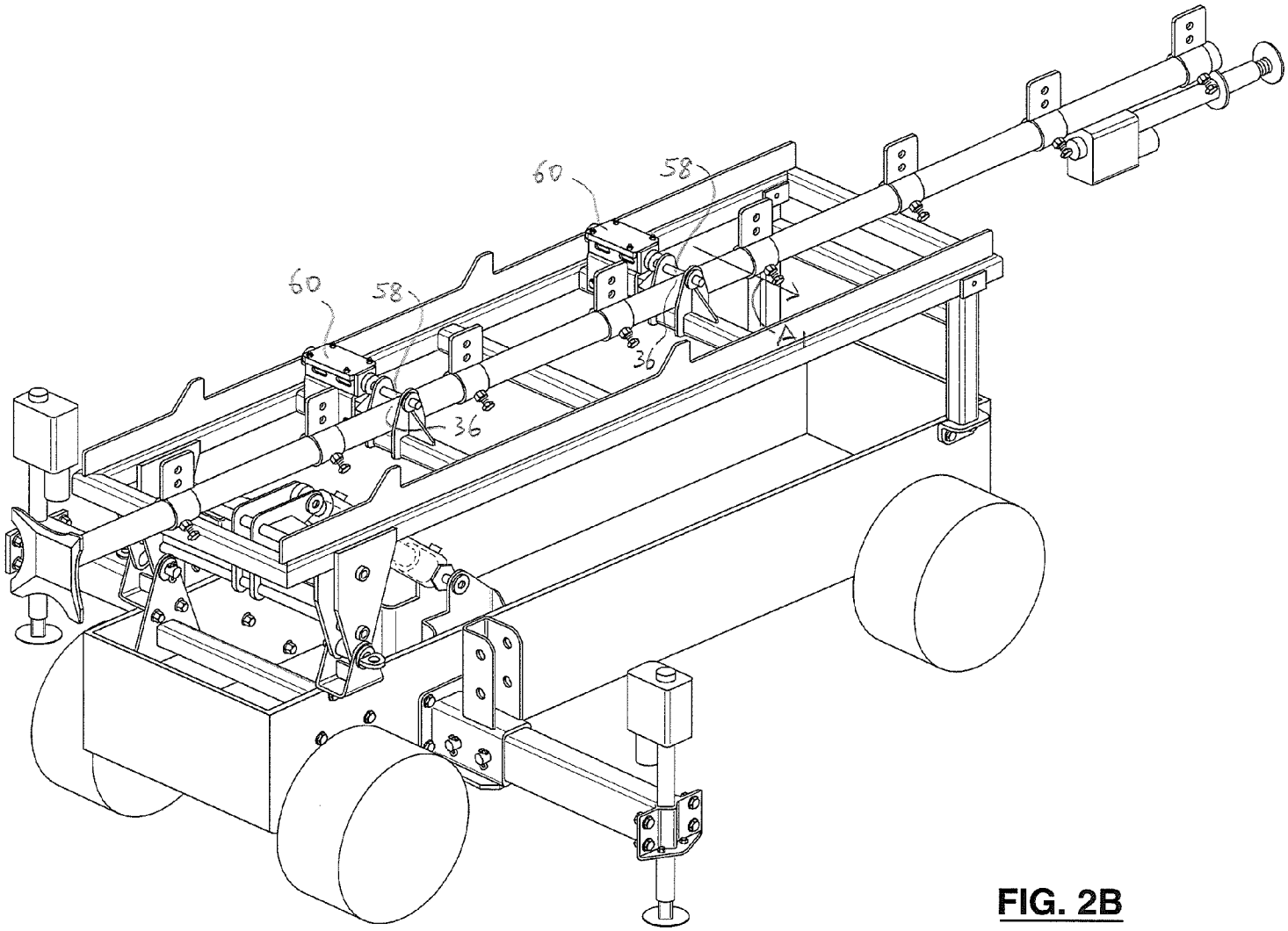
FIG. 2B is an isometric view of the central post and the carrier assembly of FIG. 2A in which fastening elements are positioned to secure the central post to the mast frame.

The process of assembling the fill fence assembly 22 on the mast frame 32 preferably begins with positioning the central post 56 on bars 62 (FIG. 1) of the mast frame 32, as shown in FIG. 2A. Once the central post 56 is in position on the bars 62, the hydraulic cylinder units 60 are suitably activated, causing the pins 58 to move to their extended positions, securing the central post 56 to the mast frame 32 (FIG. 2B). It will be understood that the parts of the central post 56 that are engaged by the extended pins 58 are the preselected portions 36 of the fill fence assembly 22. In FIG. 2B, the direction of movement of the pins 58 from their retracted positions to their extended positions is indicated by arrow "$A_1$".

It will also be understood that, when the hydraulic cylinder units 60 are suitably activated, the pins 58 are retracted from their extended positions, to their respective retracted positions. The pins 58 are shown in their retracted positions in FIG. 2A. The direction of movement of the pins 58 when they are retracted is illustrated by arrow "$A_2$" in FIG. 2A. As can be seen in FIG. 2A, when the pins 58 are moved to their retracted positions, the central post 56 is released, i.e., the central post 56 is not secured to the mast frame 32. As will be described, it is preferred that the hydraulic cylinder units 60 are remotely controlled by the operator 42, via the control unit 48. The central post 56 preferably is released after the fill fence assembly 22 has been installed in the opening. Once the central post 56 is released from the fastening elements 34, the carrier assembly 20 can be moved from the preselected location thereof to the safe zone.

As can also be seen in FIGS. 1-2B, the mast frame 32 preferably includes pairs of stops 64. Each pair of stops 64 includes two stops (identified for convenience in one such pair illustrated in FIG. 2A as $\mathbf{64}_L$ and $\mathbf{64}_R$ respectively) that are substantially parallel to each other. As will be described, when the fill fence assembly 22 has been assembled and the mast frame 32 is raised to its raised position, the stops 64 partially support the raised, assembled fill fence assembly 22.

Figure 18:
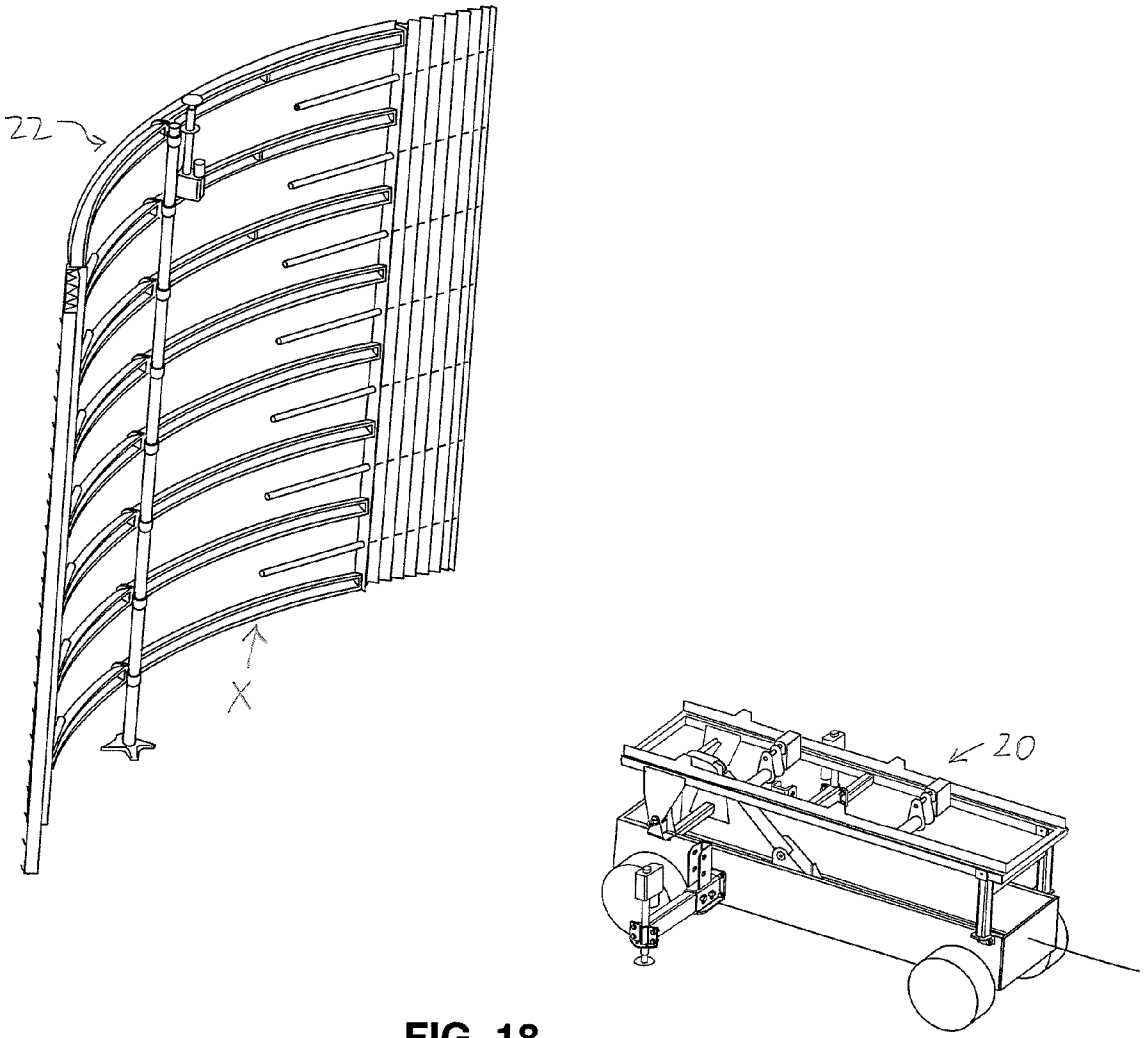
FIG. 18 is an isometric view showing the fill fence installed in the preselected location and the mast frame on the withdrawn carrier assembly in the lowered position.
Figure 19:
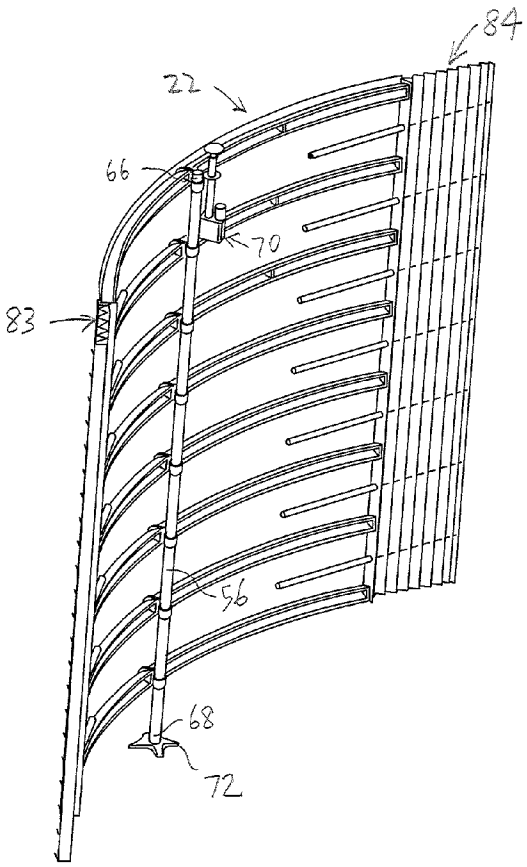
FIG. 19 is an isometric view of the fill fence installed in the preselected location.

The central post 56 preferably extends between top and bottom ends 66, 68 thereof (FIGS. 2A, 19). As illustrated in FIGS. 2A and 19, the securing means 50 preferably also includes a jack assembly 70 located at the top end 66 (and partially extendible past the top end 66) and a foot plate 72 mounted at the bottom end 68 of the central post 56. As will also be described, when the fill fence assembly 22 is positioned in the predetermined location "X" therefore (FIG. 21), the jack assembly 70 is activated, to engage the back "B" and to urge the foot plate 72 against the floor "F", so that the central post 56 is secured in a substantially vertical position at the predetermined location "X". It will be appreciated that the back "B", the floor "F", and the side walls "LW", "RW" are omitted from FIGS. 12-14B and 15-19 for clarity of illustration.

It will be understood that the jack subassembly 70 and the foot plate 72 are included in the securing means 50. Once the fill fence assembly 22 is in the predetermined location "X", the operator preferably activates the jack subassembly 70 via the control unit 48, to secure the central post 56 between the back "B" and the floor "F". In one embodiment, the central post 56 preferably is held substantially vertical by the engaged jack assembly 70 and the engaged foot plate 72.

Figure 3:
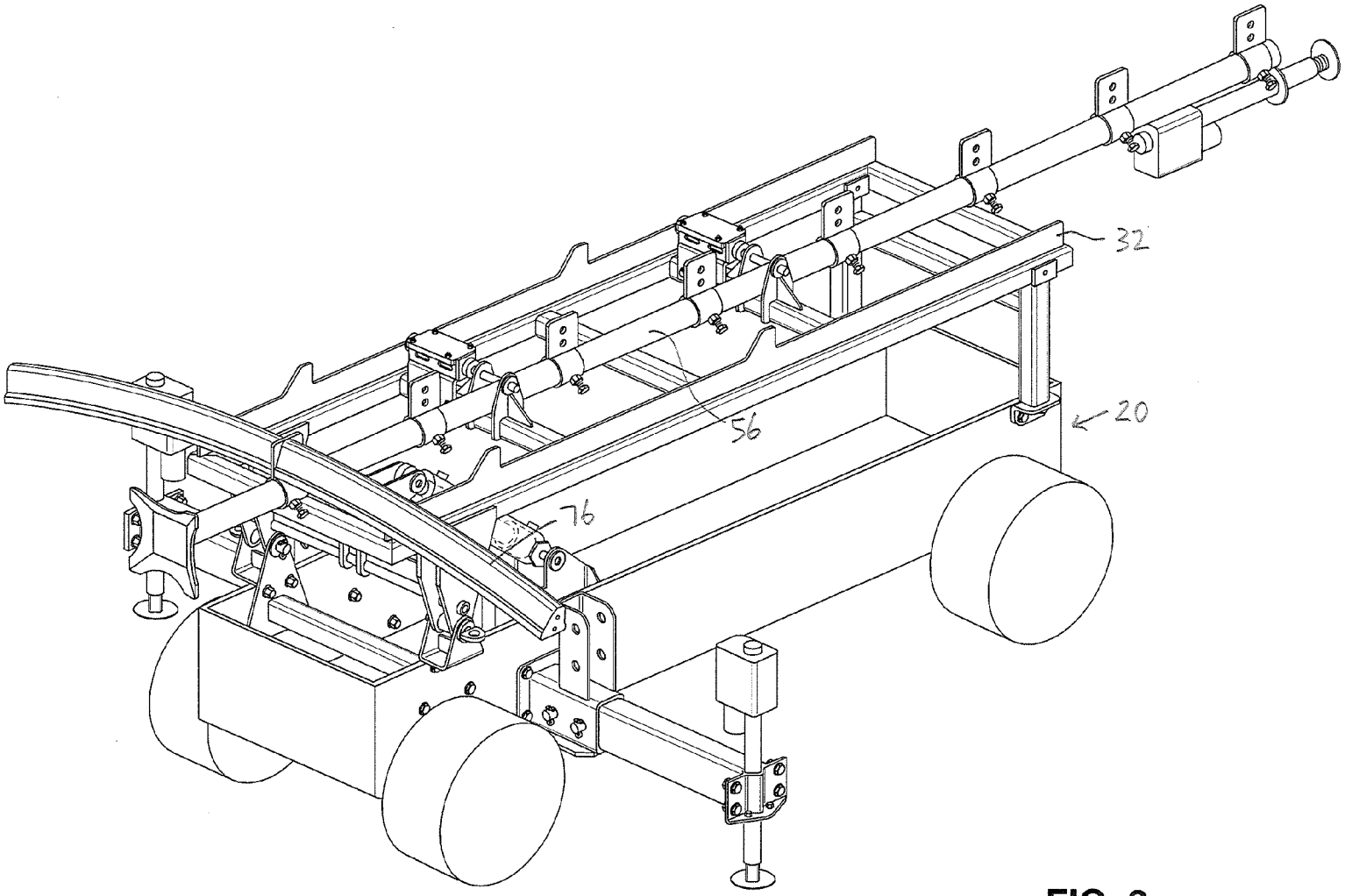
FIG. 3 is an isometric view of the central post and the carrier assembly of FIG. 2B with a portion of a cross-member of the fill fence is attached to the central post.
Figure 4:
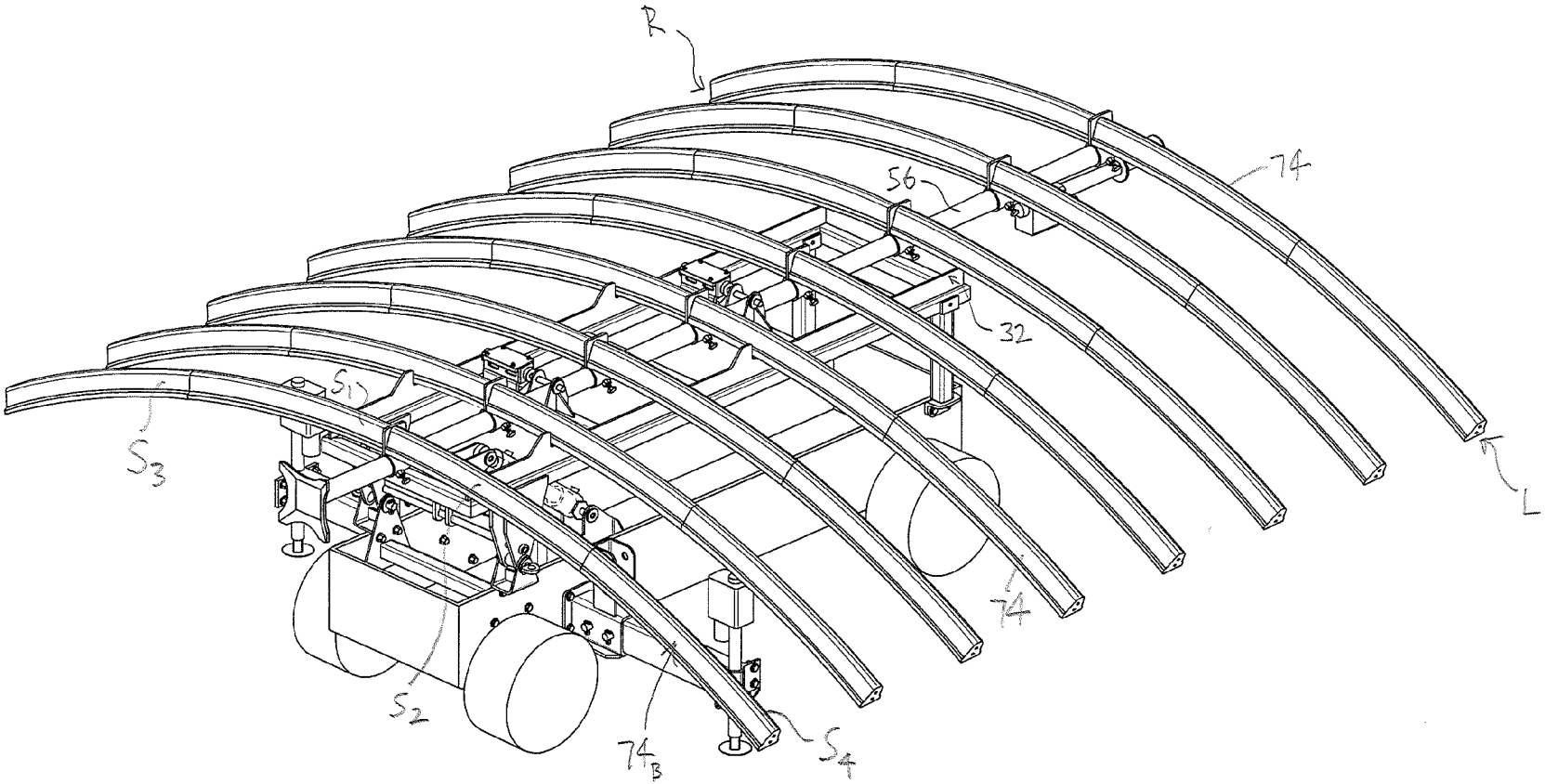
FIG. 4 is an isometric view of the carrier assembly and the central post of FIG. 3, with a number of cross-members of the fill fence attached to the central post, drawn at a smaller scale.

The fill fence assembly 22 preferably also includes the cross-members 74 that are attached to the central post 56 (FIGS. 3, 4). As can be seen in FIGS. 3 and 4, in one embodiment, each of the cross-members 74 preferably includes a number of segments 76 that are connected to each other to form the cross-member 74. For clarity of illustration, the segments that are included in the lowest cross-member (identified in FIG. 4 by reference numeral $\mathbf{74}_B$ for convenience) are respectively identified in FIG. 4 as $S_1$, $S_2$, $S_3$, and $S_4$. As can be seen in FIG. 3, it is preferred that $S_1$ and $S_2$ are first attached to the central post 56. Subsequently, the segments $S_3$ and $S_4$ are respectively attached to the segments $S_1$ and $S_2$. Any suitable means of attachment may be used. Once assembled, each of the cross-members 74 extends between left and right ends (identified as "L" and "R" in FIG. 4) and is attached at its center to the central post 56. (Such orientation refers to how the fill fence assembly 22 is viewed by an observer in the drift "D", once the fill fence assembly 22 is installed.)

As can be seen in FIGS. 4, 5, and 21, in one embodiment, the cross-members 74 preferably are curved, so that the body subassembly 54 has a generally curved shape that is convex relative to the mined-out region "Q", when the fill fence assembly 22 is in its predetermined location "X". Those skilled in the art would appreciate that, once the fill fence system 51 is in place in the opening "Z", the open region "Q" is at least partially filled with the backfill "BF". The backfill "BF" includes fines and water, and exerts significant pressure pushing outwardly on the fill fence system 51. It is believed that the generally convex curvature of the body subassembly 54 enables the installed fill fence system 51 to withstand the pressure exerted on the fill fence system 51 by the backfill "BF".

As can be seen in FIG. 5, in one embodiment, the fill fence assembly 22 preferably also includes the left and right side plates 78, 79. The left side plate 78 preferably is attached to each of the left ends "L" of the cross-members 74, and the right side plate 79 preferably is attached to the right ends "R" of the cross-members 74. Those skilled in the art would be aware that the side plates 78, 79 may be attached to the cross-members 74 in any suitable manner, e.g., by suitable fasteners such as bolts and nuts.

Figure 6:
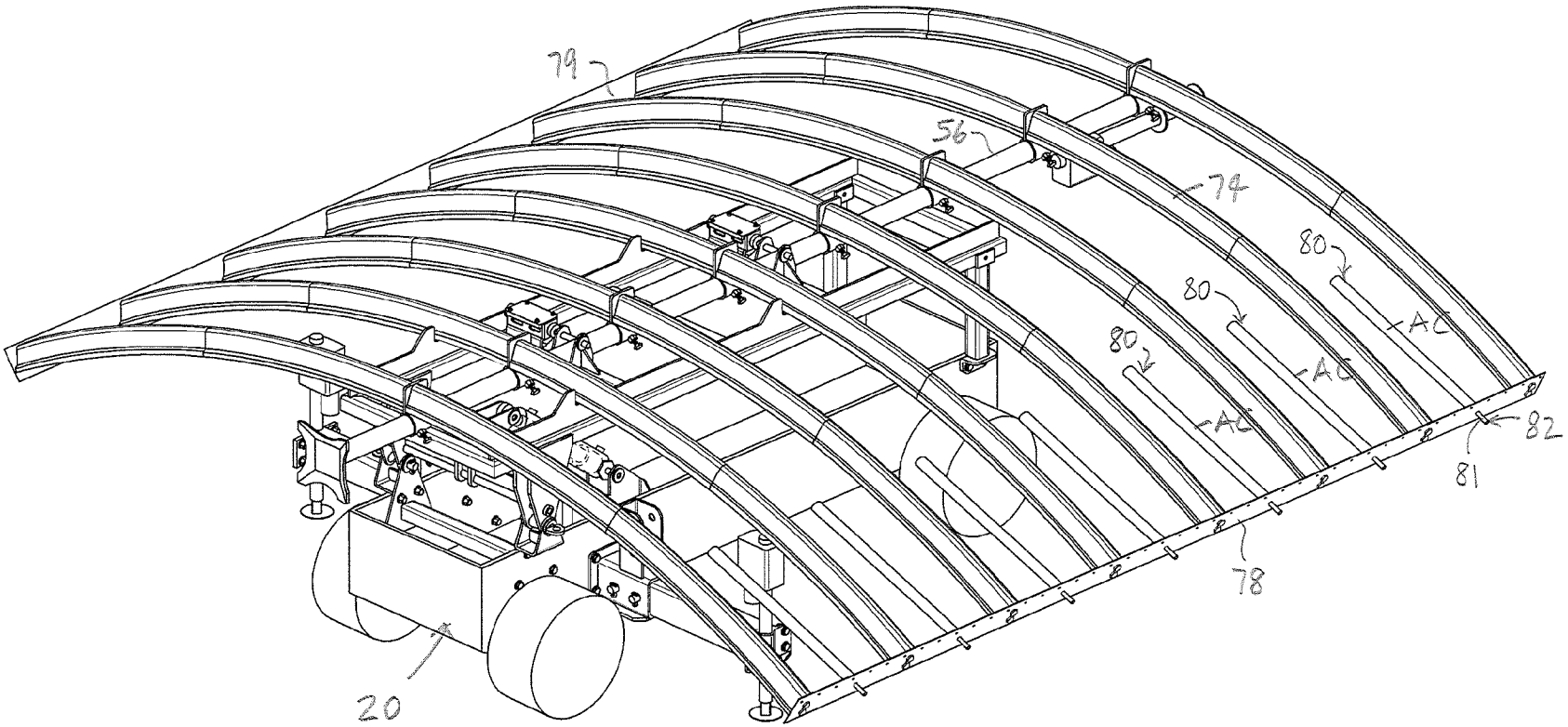
FIG. 6 is an isometric view of the central post and cross-members of FIG. 5 with a number of air cylinder subassemblies mounted to one of the side plates, including rebar elements respectively.

Preferably, and as can be seen in FIG. 5, the side plates 78, 79 both have a number of larger holes "H" in them, spaced apart at predetermined intervals. As shown in FIG. 6, it is preferred that the air cylinder subassembly 80, from which a length 81 of the rebar element 82 projects, is mounted to a selected one of the side plates to locate the length 81 in the hole "H". Each of the air cylinder subassemblies 80 includes the air cylinder "AC" and the rebar element 82, which is mounted in the air cylinder "AC". As will be described, the rebar element 82 is movable by the air cylinder "AC", when the air cylinder is activated. The rebar element 82 is movable by the air cylinder "AC" to which it is mounted, from its retracted position (shown in FIG. 6) to the extended position thereof.

Accordingly, and as can be seen in FIG. 6, the air cylinder subassemblies 80 are mounted at selected intervals along each of the side plates 78, 79, so that the lengths 81 of the rebar elements 82 of each are positioned in the holes "H" respectively to partly extend past the side plates. As will be described, the air cylinder subassemblies 80 are included in the fill fence assembly 22, and the air cylinders "AC" preferably are controllable via the control unit 48 so that they may be remotely controlled by the operator 42 via the control unit 48. The air cylinders are not activated until the central post 56 has been secured in a substantially vertical position by the jack assembly 70 and the foot plate 72. As will also be described, once each air cylinder "AC" has been activated, the air cylinder secures the rebar element 82 in the extended position thereof.

It will be understood that the elements operably connecting the air cylinder subassemblies 80 with the control unit 48 have been omitted from the drawings, for clarity of illustration. Also, in FIGS. 6 and 7A, only the air cylinder subassemblies 80 that are secured to the left side plate 78 are shown, for clarity of illustration. It will be understood that a number of the air cylinder subassemblies 80 are also secured to the right side plate 79.

It will be understood that the air cylinder subassemblies 80 and the respective rebar elements 82 mounted therein are also included in the securing means 50. It is preferred that, once the fill fence assembly 22 is in the predetermined location "X" and the central post 56 has been secured between the back "B" and the floor "F", the operator activates the air cylinder subassemblies 80 via the control unit 48, to extend the rebar elements 82 until their ends 88 engage the respective side walls "LW", "RW".

In one embodiment, the fill fence assembly 22 preferably includes the left and right expandable mesh elements 83, 84 (FIG. 7A), the inner sides of which are respectively secured to the side plates 78, 79. (In FIG. 7A, for clarity of illustration, only the section of the left expandable mesh element 83 secured to the left side plate 78 is shown.) As will be described, each of the left and right expandable mesh elements 83, 84 preferably is mounted to the respective left and right side plate in a folded or contracted configuration, with the inner side of the expandable mesh element secured to the side plate, and the outer side thereof preferably positioned a short distance outwardly from the side plate, as can be seen in FIG. 7B. As can be seen in FIG. 7B, the inner side of the expandable mesh element preferably is secured to the side plate using any suitable fasteners 85.

As noted above, for clarity of illustration, the inner and outer sides of the left expandable mesh element 83 are identified by reference characters $\mathbf{83}_I$, $\mathbf{83}_O$ respectively (FIG. 7B), and the inner and outer sides of the right expandable mesh element 84 are identified by reference characters $\mathbf{84}_I$, $\mathbf{84}_O$ respectively (FIG. 14C).

The left and right expandable mesh elements 83, 84 may be any suitable mesh or screen that, once expanded, will retain its expanded or stretched condition. As noted above, the expandable mesh elements are for at least partially covering gaps between the body subassembly 54 and the left and right walls "LW", "RW" that are defined once the fill fence assembly 22 is installed in the predetermined location "X". The manner in which the expandable mesh element 83, 84 is expanded is described further below. As also noted above, the expandable mesh elements have holes therein which are sufficiently small that, once expanded, the mesh elements will provide a substrate to which the concrete 52 (i.e., shotcrete) will readily adhere, to substantially seal over the gaps at the side walls "LW", "RW".

Figure 8A:
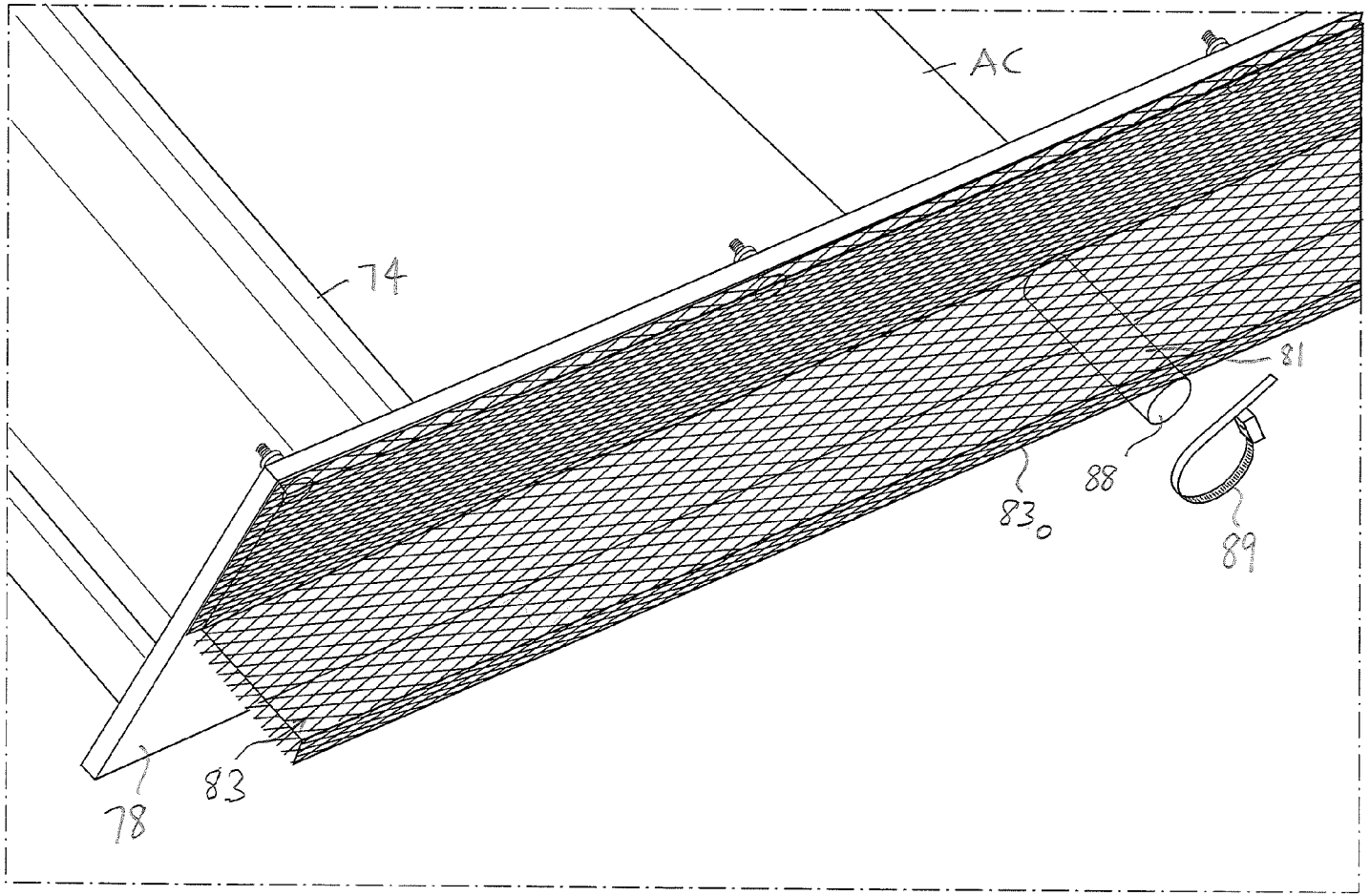
FIG. 8A is a partially exploded isometric view of the section of the expandable mesh element and the air cylinder subassembly of FIG. 7B with a connector element.
Figure 8B:
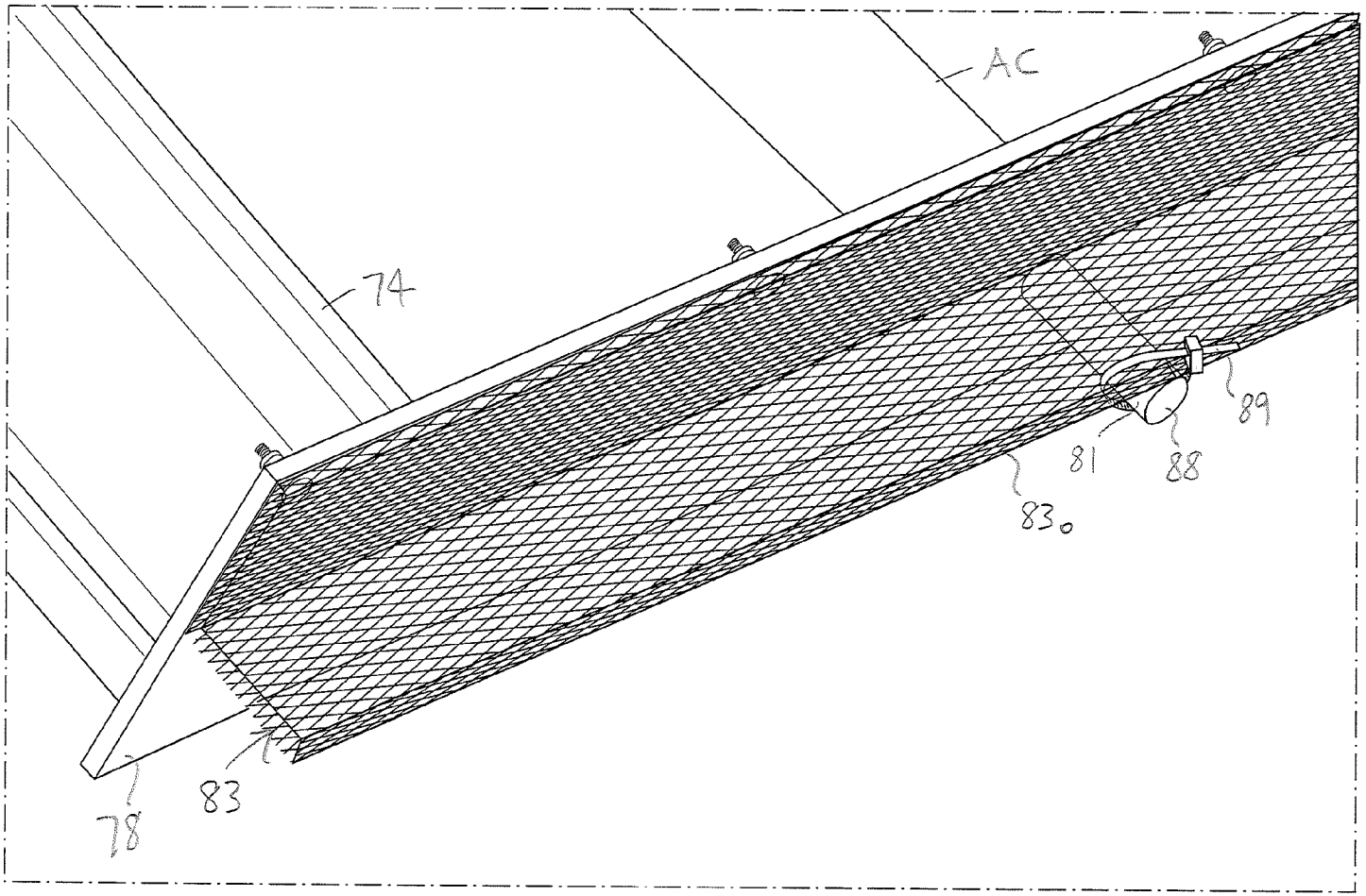
FIG. 8B is an isometric view of the section of the expandable mesh element and the air cylinder subassembly of FIG. 8A in which the connector element secures an outer end of the rebar element at an outer side of the expandable mesh element.

As can be seen in FIGS. 8A and 8B, the outer side of each of the expandable mesh elements preferably is secured to an outer end 88 of each of the rebar elements 82 by a suitable connector 89. The connector 89 is shown connecting the outer side of the expandable mesh element 83 to the outer end 88 of the rebar element 82 in FIG. 8B.

Preferably, the fill fence assembly 22 also includes the screen 90, that is preferably made of wire elements 91. As noted above, the screen 90 preferably is positioned on, and attached to, the inner side 2 of the body subassembly 54. The screen 90 may be attached to the body subassembly 54 by any suitable means.

Figure 9B:
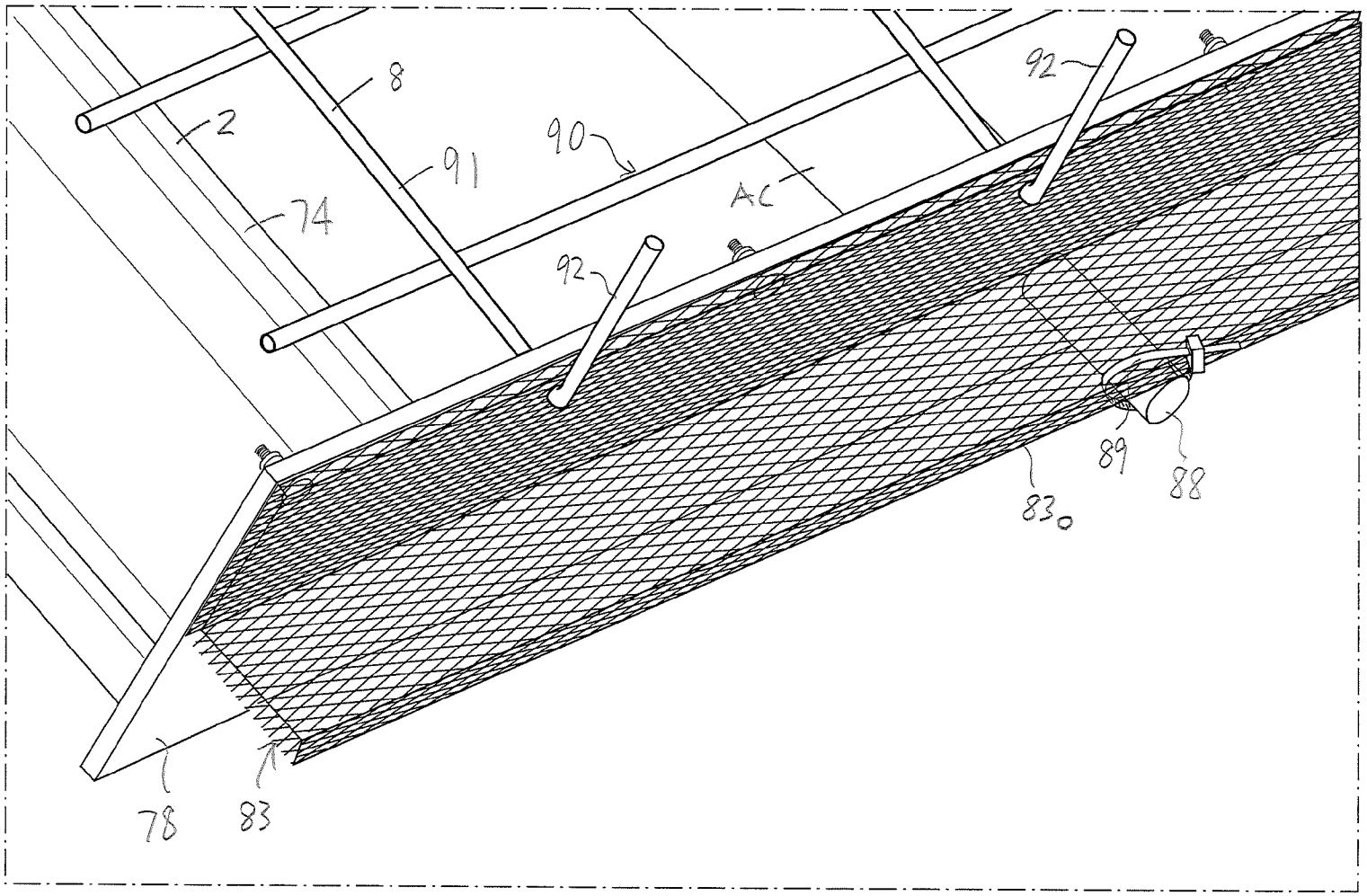
FIG. 9B is an isometric view of end portions of wires of the screen of FIG. 9A positioned in a hole in the side plate, drawn at a larger scale.

In one embodiment, end portions 92 of selected wire elements 91 preferably are extended through holes in the side plates 78, 79 and in the expandable mesh elements, and bent away from the side plate and in a direction substantially parallel to the side plate, as can be seen in FIG. 9B. Preferably, this is done at numerous locations along each of the side plates, as can be seen in FIG. 10A, to secure the screen 90 to the side plates 78, 79. The end portions 92 preferably are also used to secure another element to the side plates, as follows.

As noted above, the fill fence assembly 22 preferably also includes the membrane 93 that is positioned on the screen 90 (FIG. 10A). The membrane 93 may be any suitable material, preferably provided in the form of a flexible or semi-flexible sheet of material. As noted above, depending on whether the fill fence system 51 is intended to allow water (or air) to pass through the membrane, the membrane 93 may be permeable or impermeable (or substantially impermeable). Those skilled in the art would be aware of suitable permeable or impermeable membranes.

Preferably, where the membrane 93 is permeable, the membrane 93 is a suitable geotextile fabric sheet. Those skilled in the art would be aware of suitable geotextile fabric material. As also noted above, the membrane 93 is positioned on the interior side 8 of the screen 90, and is formed and positioned to be substantially congruent with the body subassembly 54.

Figure 10B:
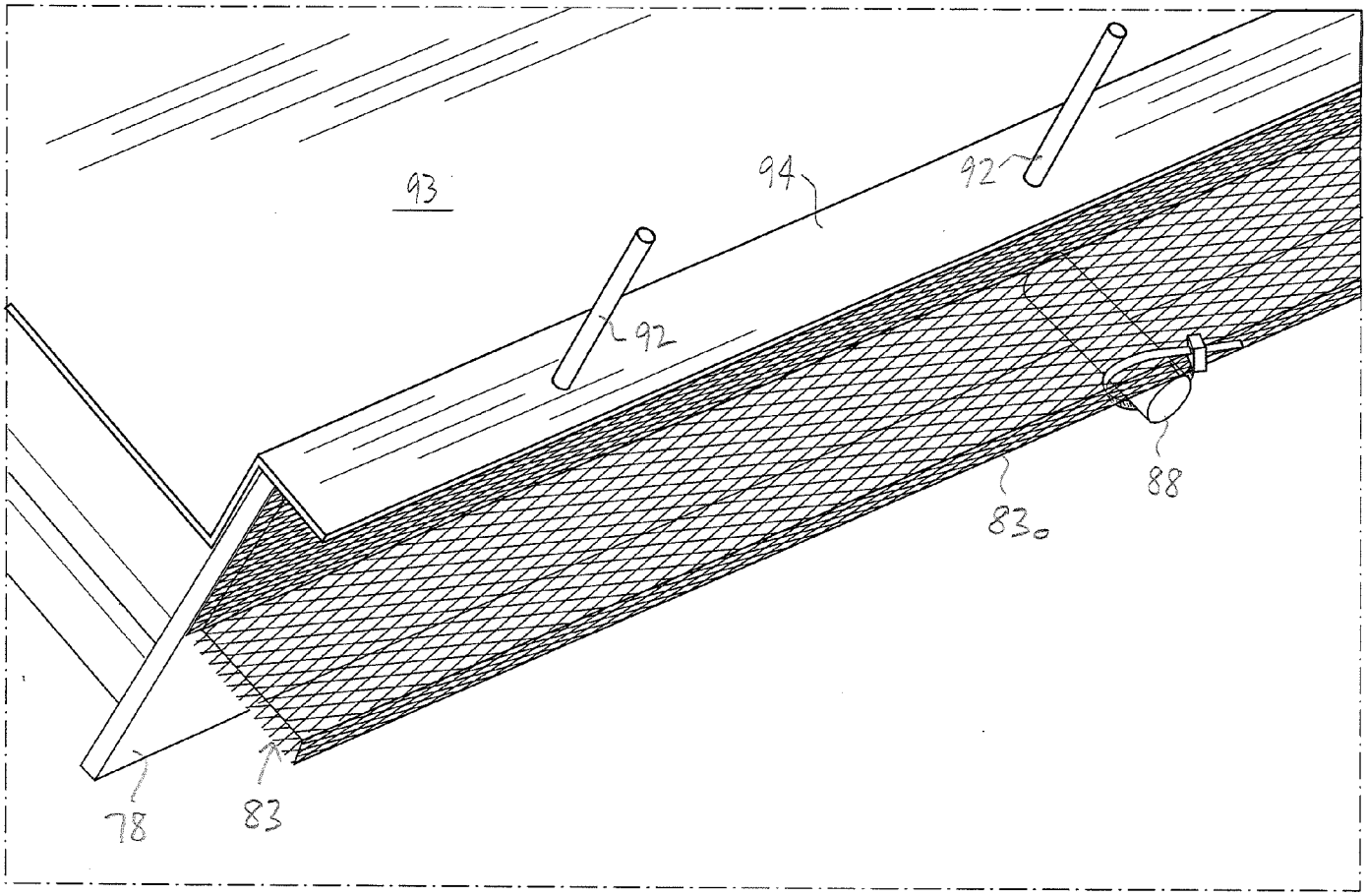
FIG. 10B is an isometric view of the end portions of FIG. 9B positioned through an outer strip of the geotextile fabric sheet of FIG. 10A, with the end portion positioned substantially parallel to the side plate, drawn at a larger scale.
Figure 10C:
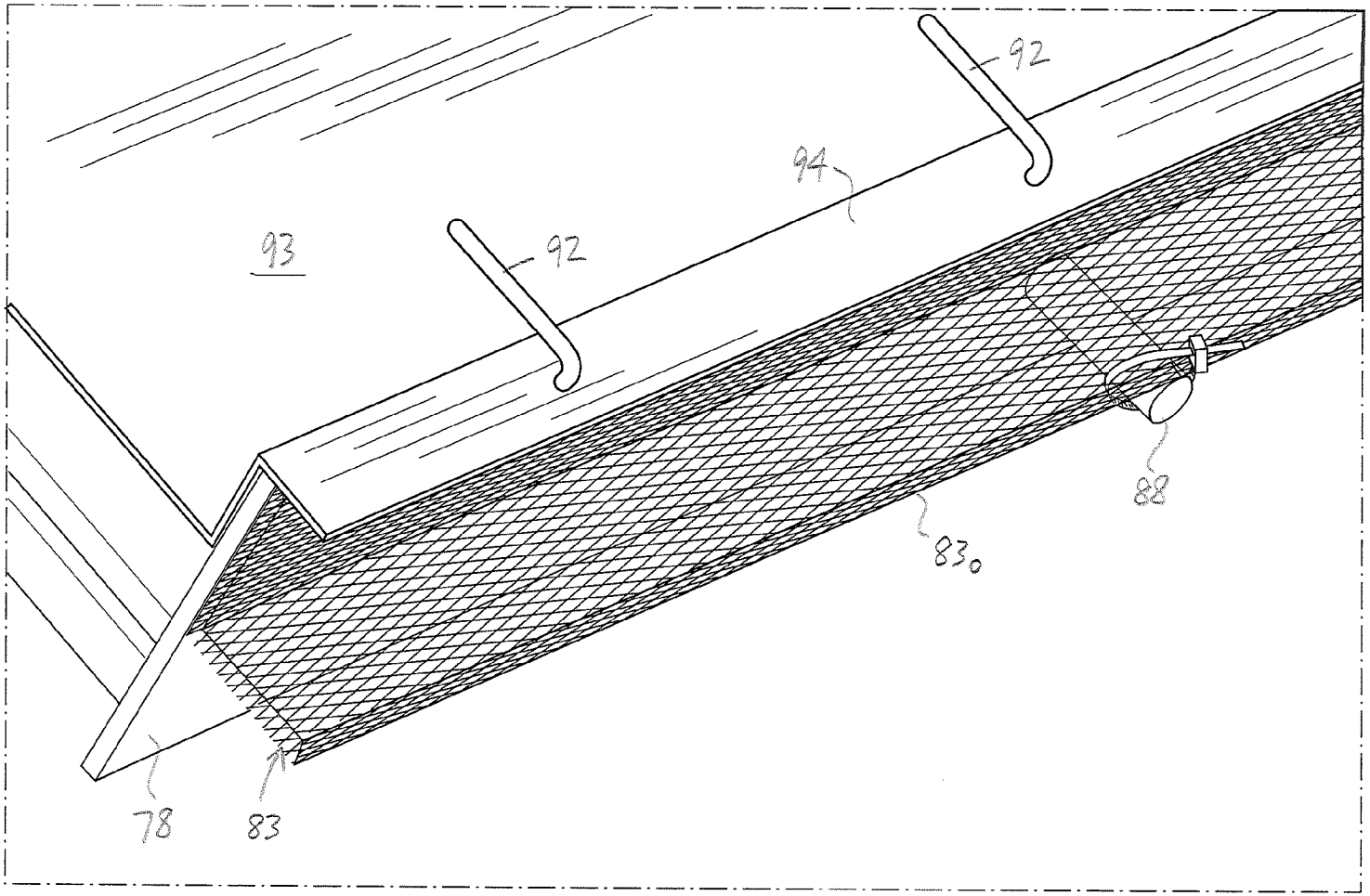
FIG. 10C is an isometric view of the end portions of FIG. 10B in which the end portions are bent inwardly to be non-parallel to the side plate.
Figure 10D:
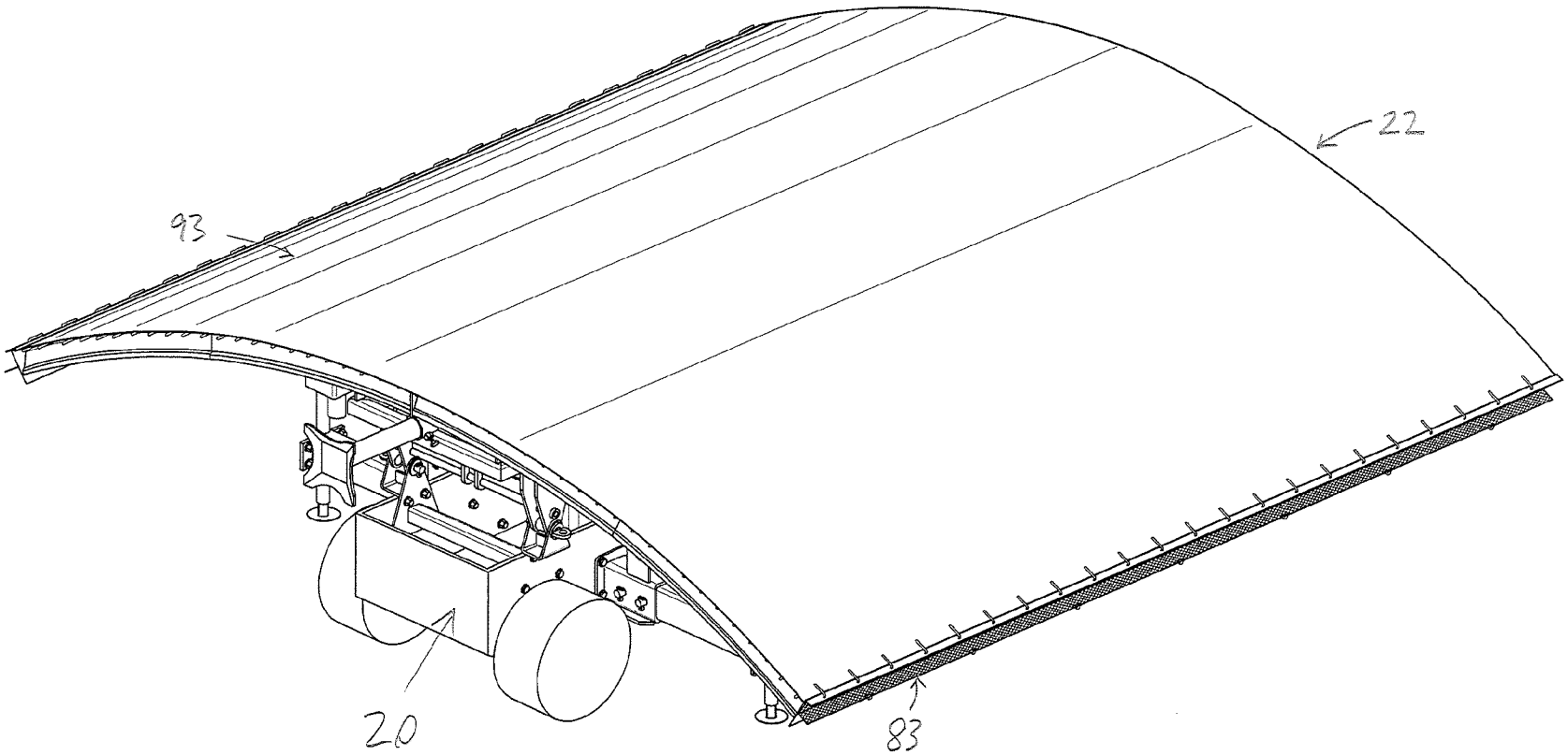
FIG. 10D is an isometric view of the assembled fill fence positioned on the carrier assembly, drawn at a smaller scale.

As can be seen in FIG. 10B, an outer strip 94 of the membrane 93 preferably extends over the side plates 78, 79, so that the end portions 92 may be pushed through the outer strip 94. As can be seen in FIG. 10C, the end portions 92 of the wires 91 preferably are then bent inwardly at approximately right angles relative to the side plates, in order to hold the membrane 93 in place. As can be seen in FIG. 10D, the end portions 92 of the wires 91 along each of the sides of the body subassembly 54 are preferably bent as described above in order to hold the membrane 93 in position on the body subassembly 54, to complete the assembly of the uninstalled fill fence assembly 22. The assembled, uninstalled fill fence assembly 22 is shown in FIG. 10D.

As can be seen in FIG. 10A, the membrane 93 preferably is sized and positioned to cover one side (the inner side 2) of the body subassembly 54. Preferably, the screen 90 is substantially congruent with the inner side 2 of the body subassembly 54, and the membrane 93 is substantially congruent with the interior side 8 of the screen 90. Those skilled in the art would appreciate that, once the fill fence system 51 is completed, if the membrane 93 is permeable, the fill fence system 51 allows water to drain through the membrane 93. The concrete (securing material) 52 positioned to cover the gaps between the body subassembly 54 on the one hand, and the walls, the back, and the floor on the other, at least partially prevents water exiting the backfill from escaping via such gaps. (Those skilled in the art would appreciate that the securing material 52, if cured concrete (but not waterproofed), may permit water to pass therethrough, to a limited extent.) Instead, the water exiting the backfill generally passes through the permeable membrane 93. Only where small amounts of concrete overlap the permeable membrane 93 (i.e., around the periphery of the body subassembly 54) is the water prevented from passing through the permeable membrane 93.

When the fill fence assembly 22 is installed in the opening, the screen 90 supports the permeable membrane 93, to help the permeable membrane 93 resist the pressure to which the permeable membrane 93 is subjected by the backfill, and in particular, by the water in the backfill. Over time, the controlled release of the water from the backfill via the permeable membrane 93 reduces the hydrostatic pressure exerted against the fill fence system 51 by the backfill "BF".

As noted above, the formation of the fill fence assembly 22 (described above) preferably takes place in the safe zone 44. Those skilled in the art would appreciate that, in an alternative arrangement, the fill fence assembly may be assembled elsewhere (in whole or in part) and, once assembled, may be positioned on the carrier assembly when the carrier assembly is in the safe zone 44. That is, the process may be "palletized" in part, with the previously-assembled fill fence assembly delivered to the carrier assembly in the safe zone.

As illustrated in FIGS. 2A-10D, the fill fence assembly 22 preferably is formed on the carrier assembly, when the mast frame 32 is in its lowered position. Preferably, the assembled fill fence assembly 22, positioned on the carrier assembly 20, is then moved from the safe zone 44 into the unsafe zone 40. As can be seen in FIGS. 11 and 12, in one embodiment, this movement preferably is accomplished by the operator 42, via the control unit 48, activating the transportation subassembly 28 of the carrier assembly 20, thereby causing the carrier assembly 20 to move into the unsafe zone 40, carrying the fill fence assembly 22 on it, while the operator 42 remains in the safe zone 44. As can be seen in FIG. 11, it is preferred that the mast frame 32 remains in its lowered position (i.e., with the assembled fill fence assembly 22 secured to it) while the carrier assembly 20 is moved to the preselected location "Y" (FIG. 12). It will be understood that, when the carrier assembly 20 is in its preselected location "Y", the assembled fill fence assembly 22 is positionable at its predetermined location "X".

As can be seen, for example, in FIG. 12, in one embodiment, the carrier assembly 20 preferably includes a stabilization mechanism 95. Preferably, the stabilization mechanism 95 is remotely activated once the carrier assembly 20 is located in the preselected location "Y" therefor. It will be understood that the stabilization mechanism 95 raises the chassis and positions the chassis 26 so that the fill fence assembly 22 may be substantially vertical when installed. This is needed in order to ensure that the assembled fill fence assembly 22 will be properly installed at the predetermined location "X" therefor. Preferably, the stabilization mechanism 95 positions the chassis 26 horizontally, or at least substantially horizontally, when the carrier assembly is in the preselected location "Y".

It is also preferred that, when the stabilization mechanism 95 is remotely activated, the stabilization mechanism 95 raises the chassis 26 at at least one end thereof by a minimum predetermined distance relative to the floor "F". When the chassis 26 is in this raised position, at least the wheels 39 mounted at a front end "FE" of the chassis 26 are raised by the minimum predetermined distance off the floor "F". For reasons that will be described below, because the chassis 26 is in a raised position when the fill fence assembly 22 is partially installed, the mast frame 32 is disengageable from the cross-members by lowering the chassis 26 until the wheels 39 at the front end "FE" thereof engage the floor "F". Preferably, the operator 42 activates the stabilization mechanism 95 to raise the chassis 26 as described above remotely, via the control unit 48.

Once the carrier assembly 20 is at the preselected location "Y" and the chassis 26 has been raised by the stabilization mechanism 95, the mast frame 32 is raised from its lowered position to its raised position (FIGS. 12-14A). It will be understood that the mast frame 32 is moved to its raised position due to activation of the lifting subassembly 38 by the operator, preferably remotely, via the control unit 48.

Figure 14A:
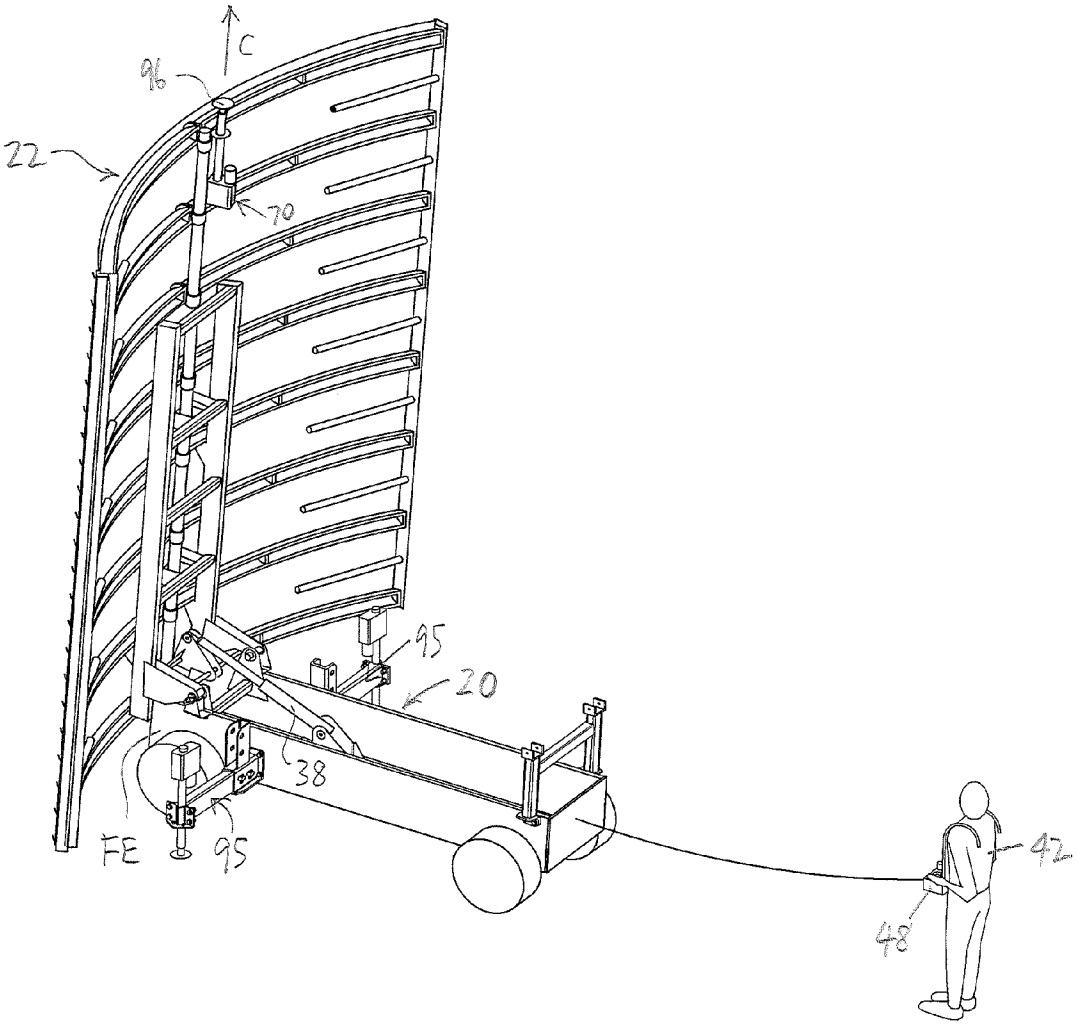
FIG. 14A is an isometric view in which the carrier assembly is in the predetermined location and the mast is in a substantially vertical position, to locate the fill fence in the preselected location.

In FIG. 14A, it can be seen that, to install the fill fence assembly 22 in the opening, the mast frame 32 preferably is in a substantially vertical position, and the fill fence assembly 22 preferably is also positioned substantially vertically. At this point, the fill fence assembly 22 is in its predetermined location "X". It will be understood that the fill fence assembly 22 is held against the mast frame 32 by the fastening elements 34, because at this point the pins 58 are still in their extended positions. Certain of the cross-members 74 also are engaged by the stops 64 on the mast frame 32, which assist in supporting the fill fence assembly 22 in its substantially vertical position.

The jack assembly 70 is then activated, and an engagement portion 96 thereof is moved upwardly (i.e., in the direction indicated by arrow "C" in FIG. 14A), until the engagement portion 96 is engaged with the back "B" (not shown in FIG. 14A). It will be understood that, as the jack subassembly 70 is activated, urging the engagement portion 96 against the back "B", the floor plate 72 is also pressed downwardly, urged against the floor "F", due to the activation of the jack subassembly 70. Preferably, such activation is controlled by the operator 42 via the control unit 48. It will be understood that, at this point, the central post 56 is still secured to the mast frame 32 by the fastening elements 34.

Figure 14B:
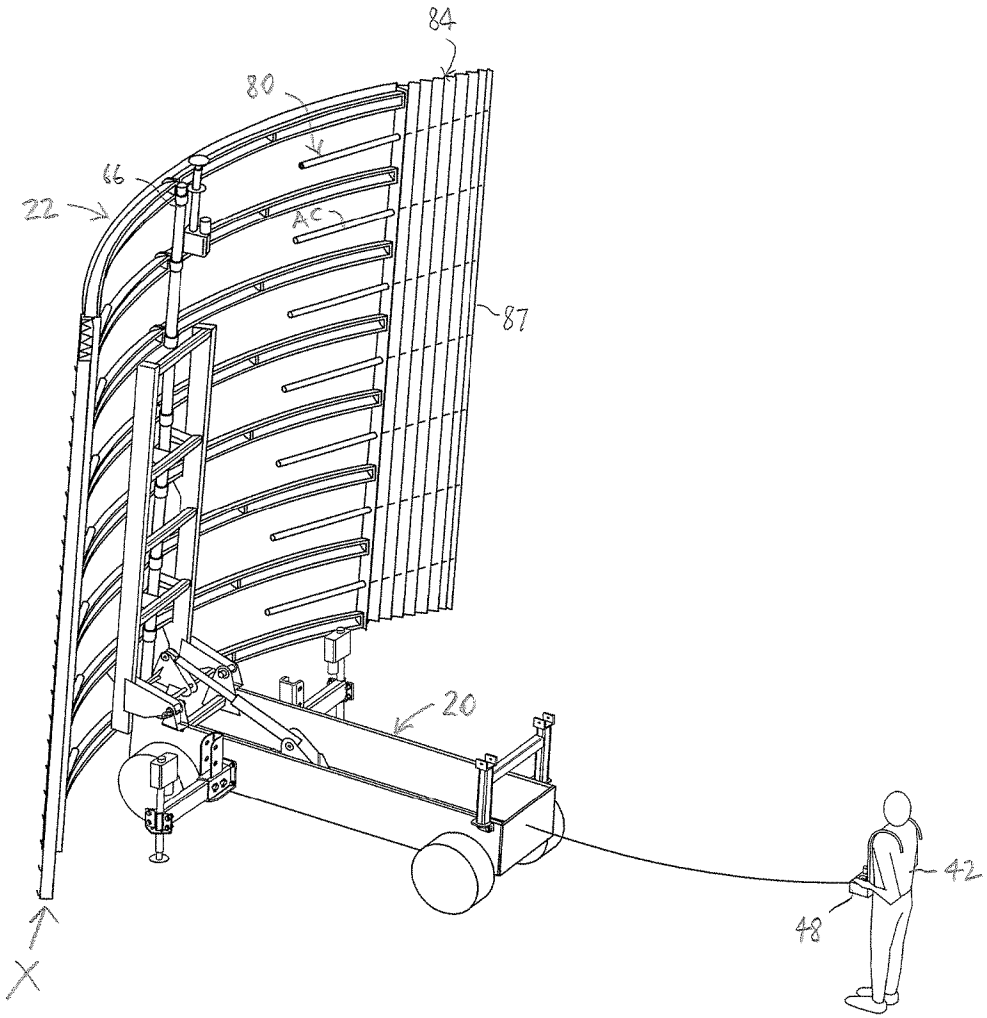
FIG. 14B is an isometric view of the carrier assembly and the fill fence of FIG. 14A in which the air cylinder subassemblies have been activated, to extend the rebar to engage the side walls so that the expandable mesh elements are expanded.
Figure 14C:
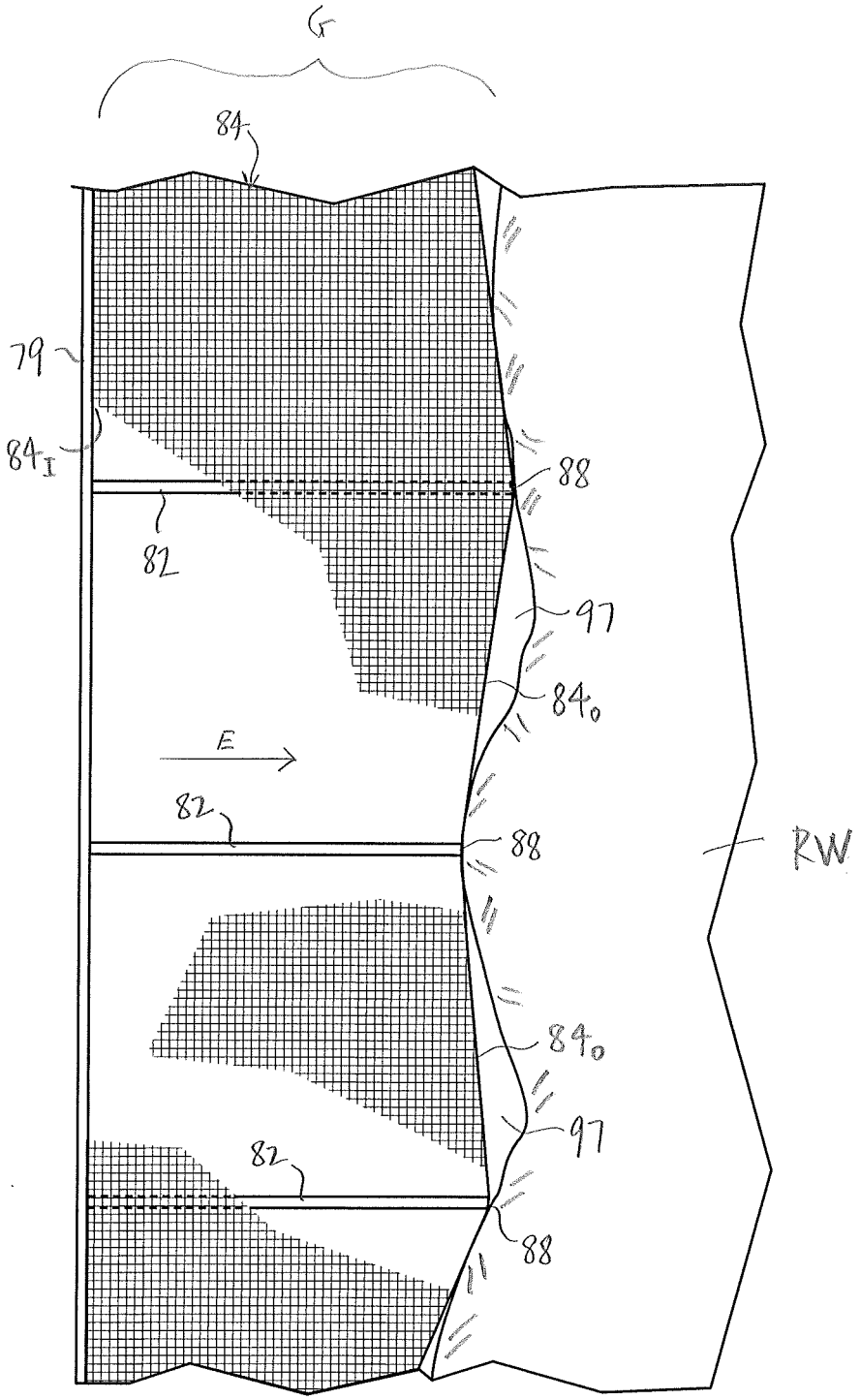
FIG. 14C is an elevation view showing the expandable mesh element in an expanded condition, with the rebar elements engaging the side wall, drawn at a larger scale.

It is preferred that, once the jack subassembly 70 has been activated and the central post 56 is secured between the back "B" and the floor "F", the air cylinder subassemblies 80 are activated. Such activation preferably is achieved remotely. Because of such activation, the rebar elements 82 are extended outwardly from their respective retracted positions until they engage the side walls "LW", "RW" (FIGS. 14B, 14C). Preferably, the air cylinder subassemblies 80 are activated by the operator 42 via the control unit 48.

For clarity of illustration, only the engagement of the outer ends 88 of certain rebar elements 82 with the right side wall "RW" is illustrated in FIG. 14C. It will be understood that the engagement of the outer ends 88 of the rebar elements 82 with the left side wall "LW" is the same, in all relevant respects. The outward movement of the ends 88 of the rebar elements 82 is indicated by arrow "E" in FIG. 14C. As can be seen in FIG. 14C, when the end 88 of the rebar element 82 engages the side wall "RW", the rebar element 82 stops moving outwardly. The air cylinder "AC" thereafter holds the rebar element 82 in position therefor, so that the end 88 thereof is tightly held against the side wall "RW" by the air cylinder "AC".

As can also be seen in FIG. 14C, when the rebar elements 82 are extended outwardly to engage the side walls, the expandable mesh element is also expanded to its expanded condition, because the outer sides thereof, at certain locations thereof, are secured to the ends 88 of the rebar elements 82. Only one side wall is shown in FIG. 14C, to simplify the illustrations. As can be seen in FIG. 14C, after the rebar elements 82 have been extended as far as possible, the result is that the right expandable mesh element 84 generally (but not completely) covers a side gap region ("G") between the side plate and the side wall. However, because the side wall "RW" has an uneven surface, there are additional gaps 97 that remain between the outer side $\mathbf{84}_O$ of the right expandable mesh element 84 and the side wall "RW" (FIG. 14C). As will be described, the gaps 97 will be covered with the shotcrete 52, in order to provide the fill fence system 51.

It will be understood that the shotcrete 52 may be partially applied while the mast frame 32 is vertical (or substantially vertical) and the central post 56 is secured to it, or the shotcrete may be subsequently applied.

For instance, those skilled in the art would appreciate that, once the fill fence assembly 22 has been installed in the opening "Z" as described above, and while the central post 56 is still secured to the mast frame 32, the shotcrete 52 may be applied, e.g., along the left and right sides, to cover the expandable mesh elements 83, 84 and the gaps 97. However, while the central post 56 is secured to the vertical mast frame 32, the mast frame 32 may partially obstruct spraying shotcrete at the upper gap $10_U$, and the carrier assembly 20 also would partially obstruct spraying shotcrete at the lower gap 10'. Accordingly, in this procedure, the shotcrete (or other securing material) 52 that has been applied between the body subassembly 54 and the left and right walls "LW", "RW" preferably is allowed to cure before the fastening elements 34 disengage from the central post 56, permitting the carrier assembly 20 to be removed from the preselected location "Y" in the unsafe zone. In this procedure, the shotcrete (or other securing material) 52 is applied to cover the upper and lower gaps $10_U$, 10' only after the carrier assembly 20 has been moved far enough away from the installed fill fence assembly 22 to permit such application.

In an alternative procedure, before any shotcrete (or other securing material) 52 is applied, the fastening elements 34 preferably are released from the central post 56, and the carrier assembly 20 is moved from its preselected location "Y", to permit the shotcrete (or other securing material) to be applied to cover the gaps $10_U$, $10_L$, $10_R$, and 10', including the gaps 97.

Figure 15:
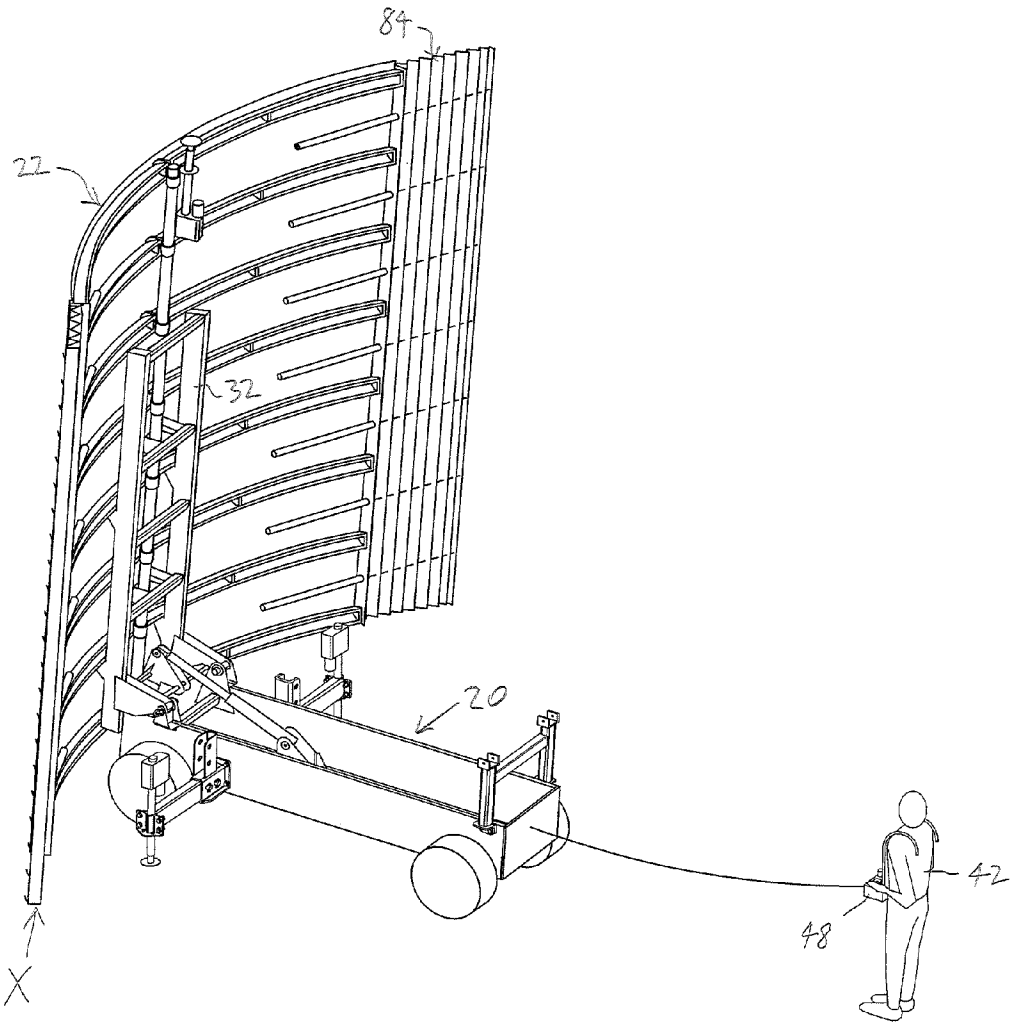
FIG. 15 is an isometric view showing the mast frame disengaged from the central post, drawn at a smaller scale.
Figure 16:
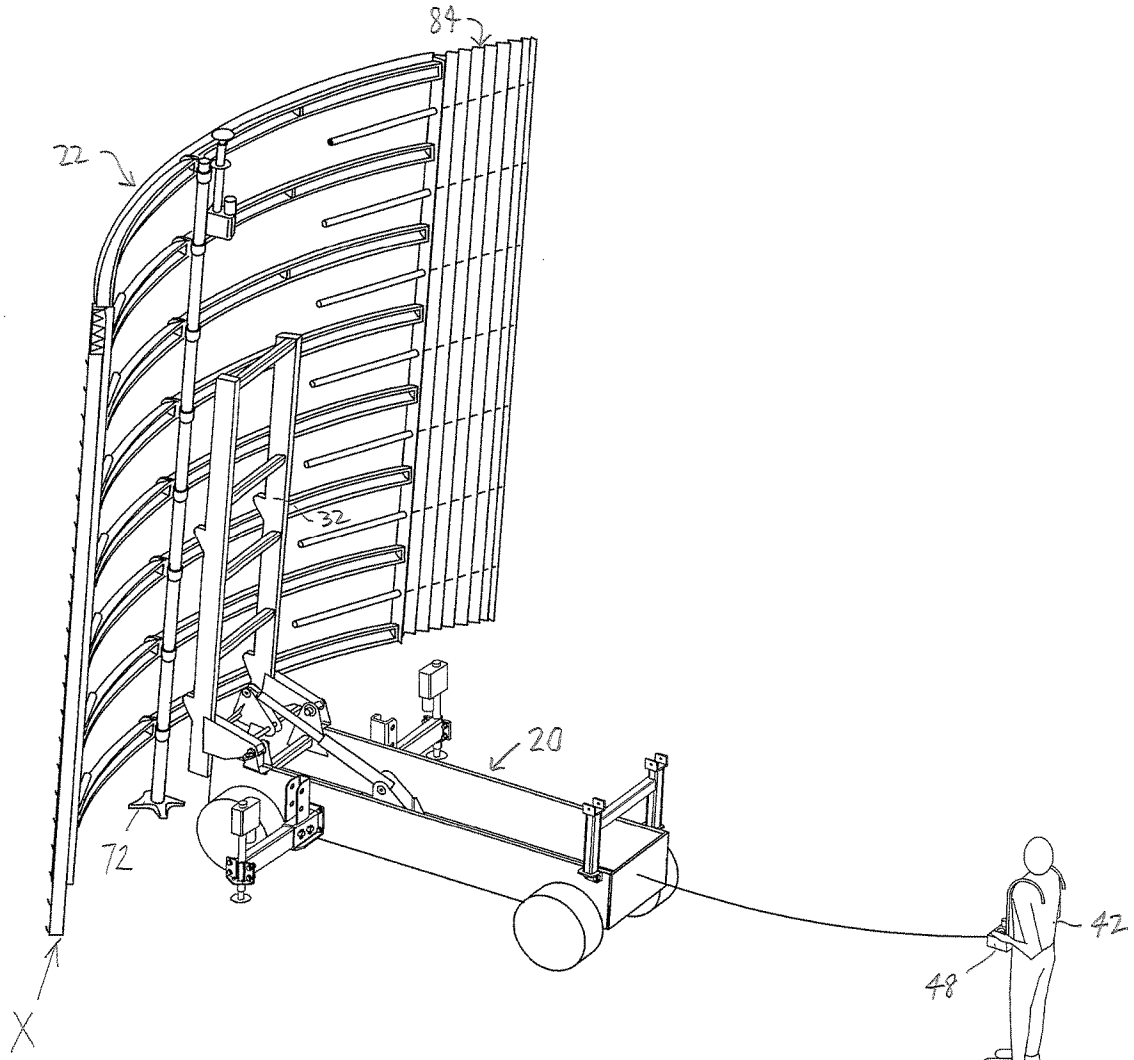
FIG. 16 is an isometric view showing the fill fence installed at the preselected location and the carrier assembly being withdrawn from the predetermined location.

Accordingly, at some point after the fill fence assembly 22 is installed (whether before or after the shotcrete or other securing material 52 has been applied, in whole or in part), the central post 56 is released from the mast frame 32. The pins 58 of the respective fastening elements 34 are retracted, to release the central post 56 from the mast frame 32. It will be understood that such retraction may be effected by the operator 42 remotely, via the control unit 48 (FIG. 15).

Preferably, once the central post 56 has been released, the stabilization mechanism 95 is retracted, thereby lowering the mast frame 32 relative to the cross-members 74 of the installed fill fence assembly 22. The retraction of the stabilization mechanism 95 may also be controlled by the operator 42 via the control unit 48. Due to such lowering, the cross-members 74 that had been engaged with and supported by the stops 64 are disengaged from the stops 64. At this point, the carrier assembly 20 is released from the installed fill fence assembly 22, and may be moved away from the fill fence assembly 22.

Next, the carrier assembly 20 preferably is moved away from the preselected location "Y" near the installed fill fence assembly 22, with the mast frame 32 still in its raised position.

The carrier assembly 20 preferably is moved further away from the installed fill fence assembly 22 (FIG. 17) (ultimately, from the unsafe zone 40 to the safe zone 44), and as can be seen in FIG. 18, as soon as convenient, the mast frame 32 preferably is moved to the retracted position thereof. The installed fill fence assembly 22 is also shown in FIG. 19. (It will be understood that a number of elements of the fill fence assembly 22 are omitted from FIG. 19 for clarity of illustration.)

From the foregoing, it can be seen that the sealing element 52 may be applied, in part, before the carrier assembly is disengaged from the installed fill fence assembly 22, and in part afterwards, or alternatively, the sealing element 52 may be applied only after disengagement of the carrier assembly from the installed fill fence assembly.

An elevation view of the installed fill fence assembly 22 prior to the application of shotcrete is provided in FIG. 20A, with a partial cross-section of the surrounding ground. (It will be understood that a number of components of the fill fence assembly 22 (e.g., the screen 90, and the membrane 93) are omitted from FIGS. 20A and 20B for clarity of illustration.) As can be seen in FIG. 20A, in addition to the gaps 97 between the outer sides of the left and right expandable mesh elements 83, 84 and the side walls "LW", "RW" respectively, the gaps $10_U$, 10' are respectively defined between the uppermost cross-member $74_U$ and the back "B", and also between the lowermost cross-member $74_L$ and the floor "F".

As can be seen in FIG. 20B, the shotcrete 52 preferably is applied to fill the gaps $10_U$, 10', and also to cover the expanded left and right expandable mesh elements 83, 84 along the sides of the fill fence assembly 22, and the gaps 97. Those skilled in the art would appreciate that the shotcrete 52 sets relatively quickly, to cover and seal the gaps $10_U$, 10', and also to cover the expanded mesh elements 83, 84, and the gaps 97, and to help secure the fill fence assembly 22 in the predetermined location to the back, the floor, and the side walls.

As noted above, where the membrane 93 is permeable, the membrane 93 permits drainage of water from the backfill "BF" through the fill fence system 51. The membrane 93 preferably covers the interior side 8 of the screen 90, which in turn is substantially congruent with the inner side 2 of the body subassembly 54. Accordingly, except to the extent that the concrete 52 may overlap with the membrane 93, the water is able to exit the backfill across substantially the entire body subassembly 54, via the membrane 93.

It will be understood that the carrier assembly 20 may be provided in separate components, or subassemblies, at the site. For example, the chassis subassembly 26 may be provided at the site separately from the mast subassembly 30 and the lifting subassembly 38, and such different elements may be combined or assembled at the site.

An alternative embodiment of the carrier assembly 120 of the invention is illustrated in FIGS. 22-25. As can be seen, for example, in FIG. 22, the carrier assembly 120 does not include a transportation subassembly.

The carrier assembly 120 preferably includes a chassis subassembly 124 that includes a chassis 126. It will be understood that the carrier assembly 120 includes a mast subassembly 130 mounted to the chassis subassembly 124 and including a mast frame 132 that is substantially the same as the mast subassembly and the mast frame described above. The carrier assembly 120 preferably includes a lifting subassembly 138 that is the same in all material respects as the lifting subassembly described above. The carrier assembly 120 preferably also includes embodiments of the fastening elements 134 of the invention, for securing the central post 56 to the mast frame 132.

Figure 22:
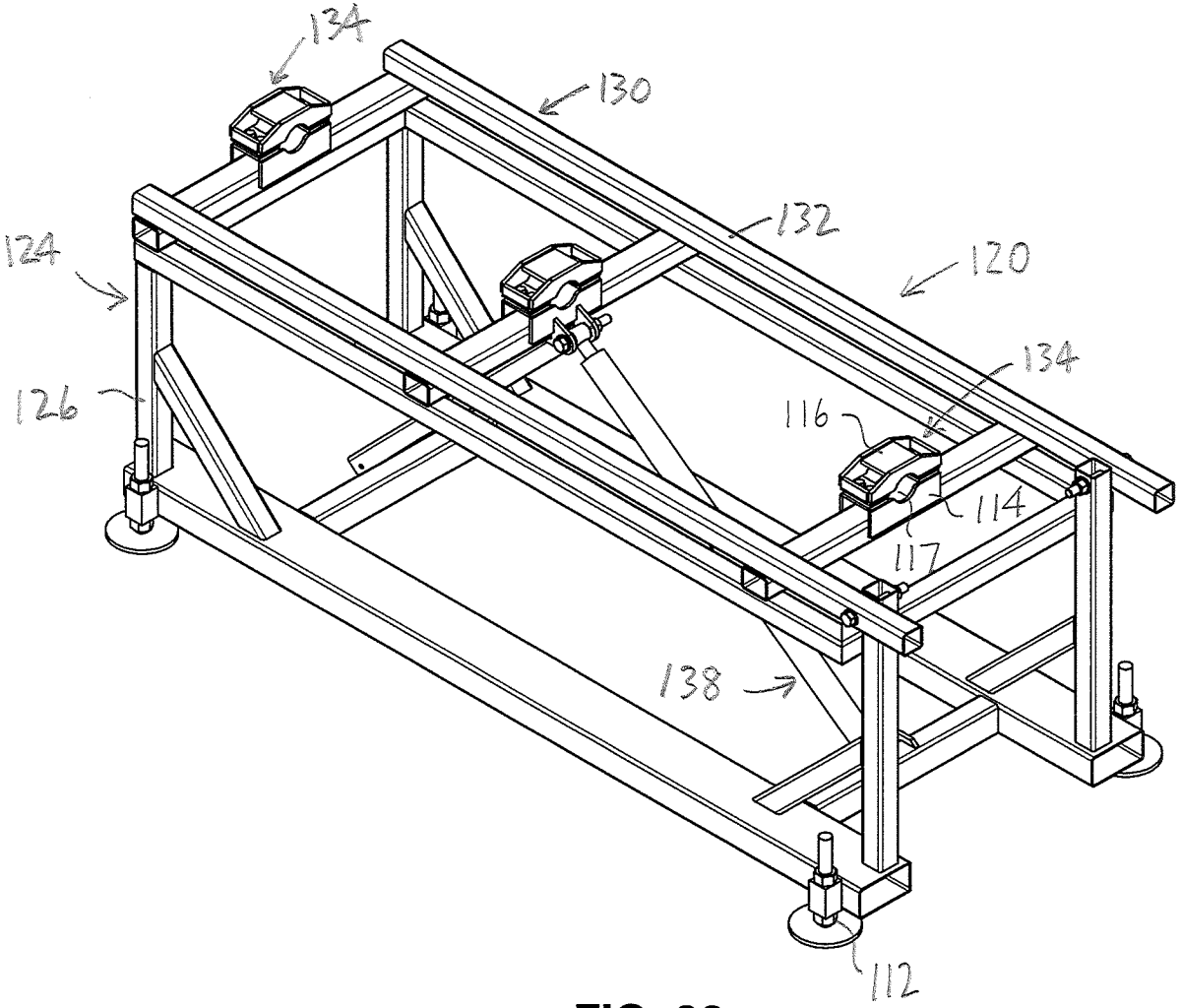
FIG. 22 is an isometric view of another embodiment of the carrier assembly of the invention, drawn at a larger scale.

In one embodiment, the fastening element 134 includes a first portion 114 mounted to the mast frame 132 and a second portion 116 that is attachable to the first portion 114 by any suitable fasteners (not shown). As can be seen in FIG. 22, the first and second portions 114, 116 preferably are formed so that, when secured together, the first and second portions 114, 116 define an aperture 117 in which the central post 56 is receivable. For example, the fasteners may be nuts and bolts. In one embodiment, after the central post 56 has been laid on the first portions 114 of the fastening elements 134, the second portions 116 are positioned to mate with the first portions 114 respectively, and the fasteners are used to secure the first and second portions 114, 116 together, so that the central post 56 is held in the apertures 117 between the first and second portions 114, 116 of the fastening elements 134.

It will be understood that, once the fill fence assembly 22 is assembled and secured to the mast frame 132 of the carrier assembly 120, the carrier assembly 120, with the mast frame 132 in the lowered position, preferably is moved to the preselected location therefor by any suitable means, e.g., by a suitable forklift (not shown). Those skilled in the art would appreciate that the forklift may, if necessary, have extended forks. This would enable the operator of the forklift to move the carrier assembly 120 to the preselected location of the fill fence assembly 22 thereof without the operator of the forklift entering the unsafe zone. Those skilled in the art would appreciate that the omission of the transportation subassembly from the carrier assembly 120 results in lower cost.

Figure 23:
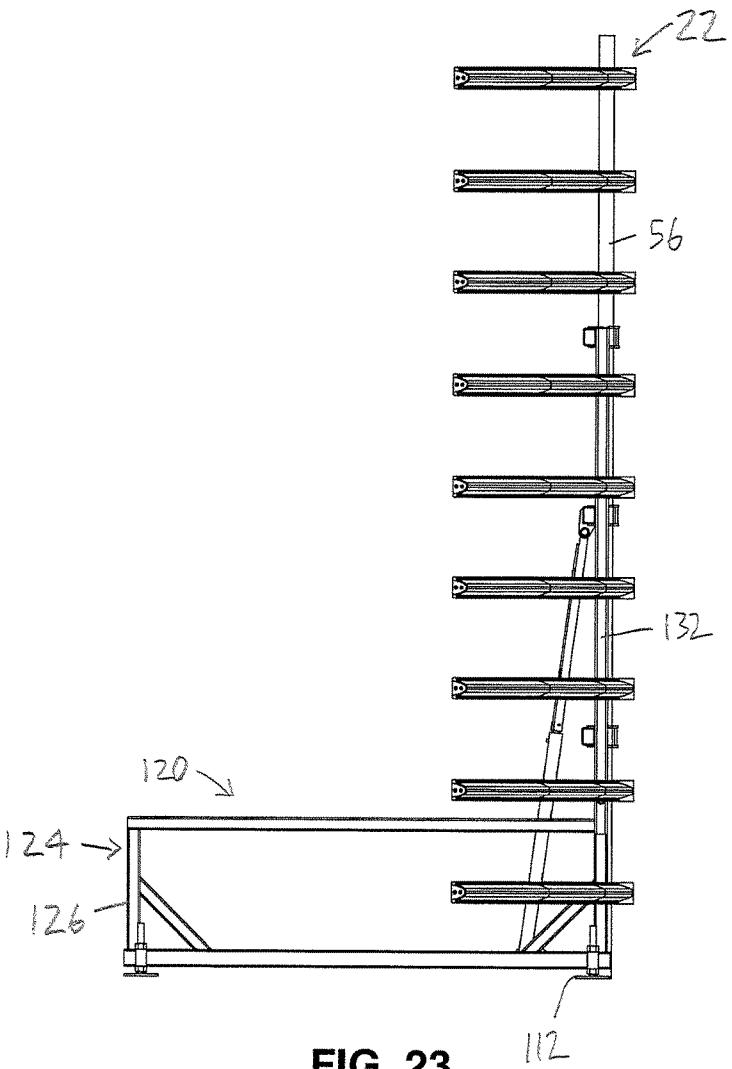
FIG. 23 is a side view of the carrier assembly of FIG. 22 with a mast frame thereof in a raised position and the fill fence assembly positioned thereon, drawn at a smaller scale.
Figure 24:
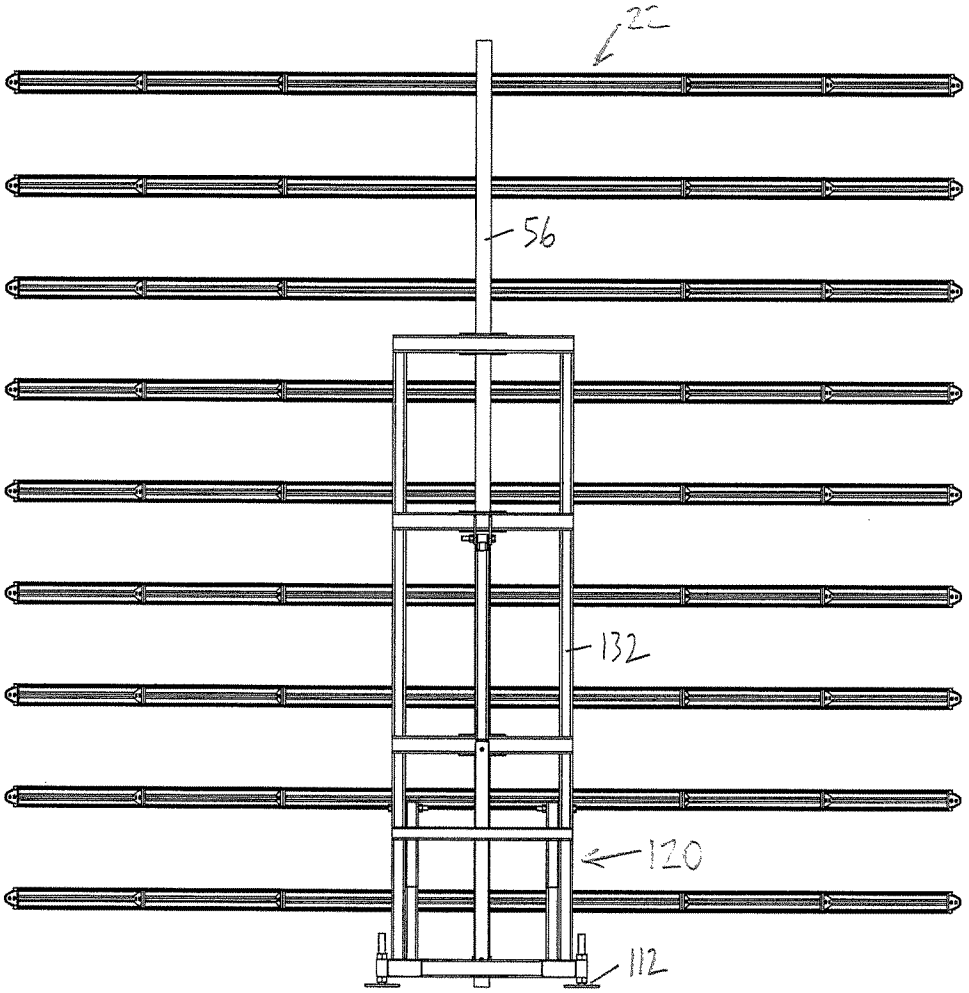
FIG. 24 is a back view of the carrier assembly and fill fence assembly of FIG. 23.
Figure 25:
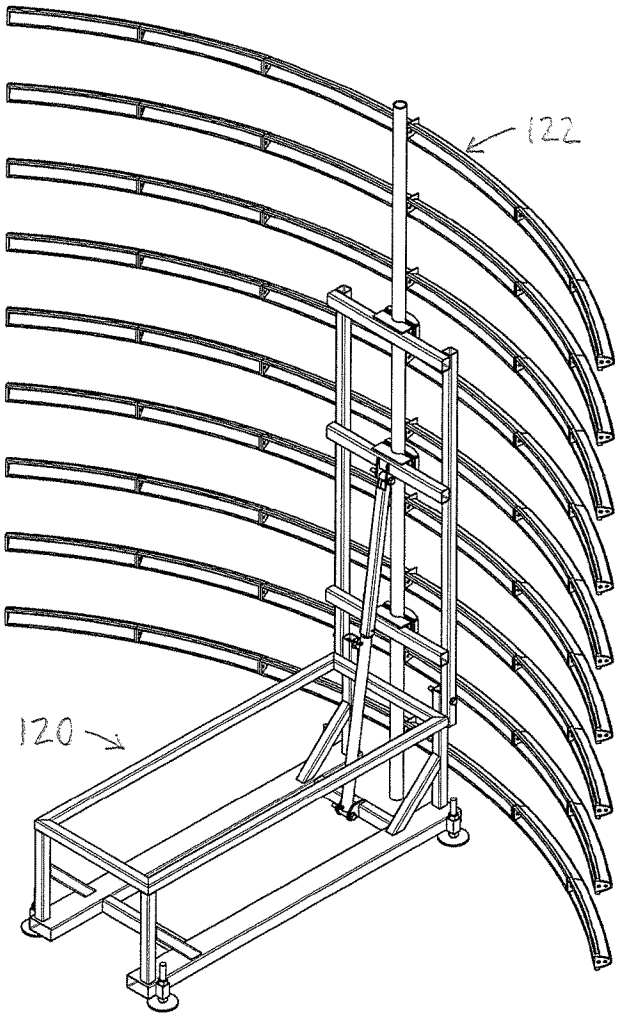
FIG. 25 is an isometric view of the carrier assembly and fill fence assembly of FIGS. 23 and 24.

The carrier assembly 120, when located in the preselected location therefor with the fill fence assembly 22 in its predetermined location, is illustrated in FIGS. 23-25. In FIGS. 23-25, the mast frame 132 is shown in the raised position thereof, with the fill fence assembly 22 secured to the mast frame 132 by the fastening elements 134. A number of elements of the carrier assembly are omitted from FIGS. 22-25, for clarity of illustration. It will also be understood that a number of elements of the fill fence assembly 22 are omitted from FIGS. 23-25 for clarity of illustration, as is the concrete or shotcrete. Also, the walls, the back, and the floor that define the opening in which the fill fence assembly 22 is located are omitted from FIGS. 23-25 for clarity of illustration.

As can be seen in FIGS. 22 and 23, the chassis subassembly 124 preferably includes a number of adjustable foot subassemblies 112 which can be used to adjust the position of the chassis 126. The adjustable foot subassemblies 112 preferably are used to position the chassis 126 substantially horizontal, when the carrier assembly 120 is located at the preselected location "Y" thereof. First, and preferably without the fill fence assembly positioned thereon, the carrier assembly 120 is positioned at the preselected location "Y" by the forklift. At that point, the operator observes the extent to which one or more of the adjustable foot subassemblies 112 may need to be adjusted so that the chassis 126 is substantially horizontal, i.e., when the carrier assembly 120 is located at the preselected location "Y". However, because the preselected location is in the unsafe zone, the carrier assembly 120 is then removed to the safe zone in order to permit the operator to adjust the adjustable foot subassemblies 112 accordingly. Those skilled in the art would appreciate that the process may be repeated until the adjustable foot subassemblies 112 are satisfactorily adjusted.

Once the adjustable foot subassemblies 112 are adjusted as required, it is preferred that the fill fence assembly 22 is positioned on the carrier assembly 120 in the safe zone. As described above, the elements of the fill fence assembly 22 may be assembled on the carrier assembly 120, in the safe zone.

With a forklift or other suitable equipment, the carrier assembly 120 (with the fill fence assembly 22 on it) is moved to the preselected location "Y". Once the carrier assembly 120 is in the preselected location, the forklift preferably is disengaged and removed.

The mast frame 132 is then raised, the lifting subassembly 138 preferably being controlled remotely by the operator (not shown). Preferably, once the fill fence assembly 22 is raised to its predetermined location to cover the opening, the air cylinders (not shown in FIGS. 22-25) are activated, to extend the rebar elements to engage the side walls. The jack subassembly (not shown) is also extended, to securely engage the central post 56 between the back "B" and the floor "F", as described above. The activation of these elements preferably is controlled remotely, by the operator.

It will be understood that, when the carrier assembly 120 is used, it is preferred that the shotcrete is sprayed onto all of the gaps that are accessible for spraying with shotcrete while the mast frame 132 is in the raised position, and the central post 56 is still secured to the mast frame by the fastening elements 134. Those skilled in the art would appreciate that, once the shotcrete has cured sufficiently, it would then be safe for the operator (not shown in FIGS. 22-25) to remove or loosen the fasteners 134 so that the second portions 116 of the fastening elements 134 are released from engagement with the central post 56.

Once this has been done, the mast frame 132 preferably is moved from the raised position to the lowered position. This may be achieved, for example, by attaching a rope or other suitable flexible connection means to the mast frame, and by the operator pulling the mast frame 132 from its raised position to its lowered position. Alternatively, the lifting subassembly 138 may be configured to move the mast frame 132 from the raised position to the lowered position. Once the mast frame 132 has been returned to the lowered position, the carrier assembly 120 may then be removed from the preselected location by the forklift or by other suitable means.

Depending on the extent to which the carrier assembly 120 obstructs the spraying of the shotcrete while the central post is substantially vertically positioned and secured to the mast frame, it may be necessary to spray additional shotcrete after the carrier assembly 120 has been withdrawn from its preselected location, to cover portions of the gaps not previously covered by shotcrete.

It will be understood that, in an alternative embodiment, the carrier assembly 120 may include the fastening elements 34 described above (i.e., including remotely controllable pins 58), to enable the operator to remotely control the fastening elements, to cause the fastening elements to release the central post once the fill fence assembly 22 is installed in the predetermined location. In this embodiment, the carrier assembly 120 may then be disengaged from the central post and removed from its preselected location before any shotcrete 52 is sprayed to cover the gaps, as described above.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A fill fence system for substantially covering an opening that is in communication with an open region when the fill fence system is located in a predetermined location, the opening being defined by a back, an opposed floor and opposing left and right walls, the fill fence system comprising:

a fill fence assembly comprising:

a body subassembly having an inner side formed to be facing toward the open region and an outer side formed to be facing away from the open region when the fill fence assembly is installed in the predetermined location, the body subassembly comprising:

a central post;

a plurality of cross-members mounted to the central post, each said cross-member extending between left and right ends thereof, the cross-members comprising an uppermost cross-member positioned to be located uppermost when the fill fence assembly is installed in the predetermined location and a lowermost cross-member positioned to be located lowermost when the fill fence assembly is installed in the predetermined location;

a left side plate and a right side plate, mounted to the left and right ends of the cross-members respectively;

at least one screen positioned on the inner side of the body subassembly, said at least one screen comprising an exterior side at least partially engaged with the inner side of the body subassembly, and an interior side facing toward the open region when the fill fence system is installed in the predetermined location;

at least one membrane positioned on the interior side of said at least one screen;

a plurality of air cylinder subassemblies mounted to the left and right side plates respectively, each said air cylinder subassembly comprising an air cylinder and a rebar element, the air cylinder being activatable to extend the rebar element away from the central post to an extended position thereof;

left and right expandable mesh elements;

said left expandable mesh element extending between an inner side thereof secured to the left side plate and an outer side thereof secured to respective outer ends of the rebar elements positioned proximal to the left side plate;

the right expandable mesh element extending between an inner side thereof secured to the right side plate and an outer side thereof secured to respective outer ends of the rebar elements positioned proximal to the right side plate;

whereby, when the fill fence assembly is in the predetermined location, the central post is positioned in a non-horizontal position between the back and the floor, to locate the cross-members in non-vertical positions respectively, to locate the left and right ends of the cross-members proximal to the left and right walls respectively, whereby, when the fill fence assembly is in the predetermined location, the left and right side plates define respective left side and right side gaps between the left side plate and the left wall, and the right side plate and the right wall, and upon activation of the air cylinders, the outer ends of the rebar elements are extended to engage the left and right walls respectively, to expand the left and right expandable mesh elements at least partially over the left side gap and the right side gap respectively.

2. The fill fence system according to claim 1 in which:

when the fill fence assembly is in the predetermined location, the uppermost cross-member defines an upper gap between the uppermost cross-member and the back, and the lowermost cross-member defines a lower gap between the lowermost cross-member and the floor; and the fill fence system additionally comprises a securing element at least partially covering the upper gap, the lower gap, and the left and right side gaps.

3. The fill fence system according to claim 2 in which the securing element that at least partially covers the left and right side gaps is at least partially supported by the left and right expandable mesh elements respectively.

* * * * *